US007810204B2

(12) United States Patent
Godfroid et al.

(10) Patent No.: US 7,810,204 B2
(45) Date of Patent: Oct. 12, 2010

(54) CLEANING IMPLEMENTS AND SUBSTRATES FOR CLEANING A COMPRESSIBLE RESILIENT SURFACE

(75) Inventors: Robert Allen Godfroid, Cincinnati, OH (US); Jonathan Joseph Powell, Cincinnati, OH (US); David Edwards Mallard, New York, NY (US); Michael Jurgen Strasser, San Francisco, CA (US); Samuel Blagden Truslow, San Francisco, CA (US); Adrian Benton James, Palo Alto, CA (US)

(73) Assignee: The Procter & Gamble Company, Cincinnati, OH (US)

( * ) Notice: Subject to any disclaimer, the term of this patent is extended or adjusted under 35 U.S.C. 154(b) by 1464 days.

(21) Appl. No.: 11/179,247

(22) Filed: Jul. 12, 2005

(65) Prior Publication Data

US 2006/0010627 A1 Jan. 19, 2006

Related U.S. Application Data

(60) Provisional application No. 60/587,093, filed on Jul. 12, 2004, provisional application No. 60/632,284, filed on Dec. 1, 2004.

(51) Int. Cl.
*A47L 13/02* (2006.01)

(52) U.S. Cl. ..... 15/104.8

(58) Field of Classification Search ..... 15/1.52, 15/104.002, 104.8, 208, 221, 236.01, 40
See application file for complete search history.

(56) References Cited

U.S. PATENT DOCUMENTS 3,363,276 A * 1/1968 Thomas, Jr. ..... 15/105
3,408,681 A * 11/1968 Isakson ..... 15/257.2
4,255,776 A * 3/1981 Cantelli ..... 361/213
5,077,856 A * 1/1992 Freundl ..... 15/104.002
5,497,525 A * 3/1996 Woodgate ..... 15/104.8
5,829,143 A * 11/1998 Gilliam ..... 30/136.5
6,119,297 A * 9/2000 Ohm et al. ..... 15/119.2
7,003,844 B1 * 2/2006 Mosby-Pinkney ..... 15/104.002
7,020,926 B2 * 4/2006 McKay ..... 15/104.002
7,033,965 B2 * 4/2006 Takabayashi et al. ..... 442/381
7,039,982 B1 * 5/2006 McKay ..... 15/104.002
7,065,822 B1 * 6/2006 Vandenburg ..... 15/104.002
7,386,907 B2 * 6/2008 Otsuka et al. ..... 15/104.002

(Continued)

FOREIGN PATENT DOCUMENTS

JP 09224901 A 9/1997

(Continued)

OTHER PUBLICATIONS

PCT International Search Report, 3 Pages, Mailed Nov. 28, 2005.

*Primary Examiner*—David B Thomas
(74) *Attorney, Agent, or Firm*—Larry L. Huston; Leonard W. Lewis; Steven W. Miller

(57) ABSTRACT

A cleaning implement for removing particulate soils from a compressible resilient surface is provided.

The cleaning implement includes a ramp for pressing particulates against the compressible resilient surface and a collection member for collecting the particulates which are projected away from the compressible resilient surface when the cleaning implement is moved across the compressible resilient surface.

17 Claims, 22 Drawing Sheets

U.S. PATENT DOCUMENTS

2002/0065012 A1* 5/2002 Takabayashi et al. ..... 442/381
2003/0044569 A1* 3/2003 Kacher et al. ..... 428/100
2003/0049407 A1* 3/2003 Kacher et al. ..... 428/100
2003/0126709 A1* 7/2003 Policicchio et al. ..... 15/228
2003/0167583 A1* 9/2003 Shizuno et al. ..... 15/27
2004/0031119 A1* 2/2004 McKay ..... 15/227
2005/0188485 A1* 9/2005 McKay ..... 15/104.002
2006/0117512 A1* 6/2006 Otsuka et al. ..... 15/228
2006/0137119 A1* 6/2006 Otsuka et al. ..... 15/104.002

FOREIGN PATENT DOCUMENTS

JP 11137503 A * 5/1999
JP 2003-135348 5/2003
JP 2003199698 A * 7/2003
JP 2004033572 A * 2/2004
JP 2004208939 A * 7/2004
JP 2004230083 A * 8/2004

* cited by examiner

CLEANING IMPLEMENTS AND SUBSTRATES FOR CLEANING A COMPRESSIBLE RESILIENT SURFACE

CROSS-REFERENCE TO RELATED APPLICATIONS

This application claims priority to U.S. Provisional Application Ser. Nos. 60/587,093 filed, Jul. 12, 2004 and 60/632,284 filed Dec. 1, 2004.

TECHNICAL FIELD

The invention relates to cleaning implements which can be used with a collection member connected to the implement for removing particulate soils or debris, such as food crumbs, cereals, sand, and the like, and/or soils capable of entanglement such as hair, fuzz, threads, lint or any other fibrous soils from compressible resilient surfaces, such as carpets, straw mats (e.g., tatami), cushions, mattresses, and the like. The collection member can be either reusable or disposable.

BACKGROUND OF THE INVENTION

Removing soils and debris from compressible resilient surfaces such as carpet in a quick, easy and convenient manner can be particularly difficult. Part of the difficulty comes from the broad range of soils, which are found on these surfaces, and the ability of these soils to get entangled to the carpet which in turn, makes them hard to remove.

Unlike hard floor surfaces such as vinyl floors, hard wood floors or ceramic tiles, which are mainly covered with "loose" soils, compressible resilient surfaces contain both "loose soils" and "soils capable of entanglement". By "loose soils" it is meant any soil, which sits freely on top of the surface to be cleaned and which can be displaced easily. Typical loose soils include food crumbs, sugar grains, cereals, paper, gravel, sand, grass and the like. By "soils capable of entanglement" it is meant any soil, which is trapped around, for example, carpet fibers and which cannot be displaced easily. Compressible resilient surfaces, such as carpets, have fibers causing loose soils to get snagged in the fibers. Typical soils capable of entanglement include human hair, pet hair, threads and the like.

The literature is replete with devices, such as vacuum cleaners or carpet sweepers, which can be used to remove particulate soils or debris and clean compressible resilient surfaces.

Vacuum cleaners generally require a connection to an electrical outlet to generate the airflow capable of transporting the particles. In addition, vacuum cleaners are relatively heavy and cumbersome, and consequently, are not convenient for everyday use. "Lighter" vacuum cleaners (having a weight of less than about 3 kg), which are battery operated, have been developed. Although these are more user-friendly in the sense that they are more maneuverable and easier to use, they are not very effective at removing large particles.

Light weight sweepers have also been developed, which typically include a rotating brush, which is located in the front of the sweeper and which can be either electrically or mechanically driven. The rotating brush includes bristles, which throw or kick particles into a collection bin. Once the user has finished cleaning a carpet, he or she can empty the bin into a trash container. However, it has been observed that hair tends to wrap around the rotating brush. Over time, the rotating brush becomes saturated with hair, and, as a result, it reduces the ability of the rotating brush and its bristles to throw or kick particulates into the collection bin. Eventually, a user needs to remove by hand the hair entangled in the bristles of the brush. The process of removing wrapped hair from a brush is both inconvenient and unhygienic. In order to prevent hair from getting entangled on the rotating brush, some carpet sweepers include continuous rotating blades as opposed to individual bristles. These sweepers are relatively effective at throwing or kicking particulate soils or debris into a collection bin but they require a source of mechanical or electrical energy for rotating a brush or blades.

It is therefore one object of this invention to provide a cleaning implement which is used with a collection member or members, which is preferably disposable, for removing particulate soils, or debris and/or soils capable of entanglement from compressible resilient surfaces in a convenient and hygienic manner.

It is also one object of the invention to provide a cleaning implement capable of removing particulate soils, or debris and/or soils capable of entanglement from a compressible resilient surface without requiring any mechanical or electrical source of power.

SUMMARY OF THE INVENTION

In one embodiment the invention is directed to a cleaning implement for removing particulates from a compressible resilient surface, the cleaning implement comprising at least one ramp having an outer surface for pressing the particulates against the compressible resilient surface, the ramp having a lower edge and a collection member for collecting the particulates, wherein the collection member is operably connected to the ramp, the collection member having a collection surface, wherein the particulates are projected away from the compressible resilient surface onto the collection surface when the outer surface of the ramp is compressibly moved across the compressible resilient surface and against the particulates.

In another embodiment the invention is directed to a cleaning implement for removing large particulates from a compressible resilient surfaces, the cleaning implement comprising at least one ramp having an outer surface, the outer surface having a vertical height and an horizontal width, wherein the cross-sectional shape of the outer surface in a vertical plane is such that it has at least one tangential angle of less than about 70 degrees when measured at a vertical height of between about 2 and 30 mm, such that the ramp passes on top of the large particulates and the large particulates are projected away from the compressible resilient surface when the outer surface of the ramp is compressibly moved across the compressible resilient surface and the large particulates and a collection member for collecting the projected particulate soils, wherein the collection member is operably connected to the ramp.

In another embodiment the invention is directed to a cleaning implement for removing particulates from a compressible resilient surface, the cleaning implement comprising at least one ramp having an outer surface for pressing the particulates against the compressible resilient surface, the ramp having a lower edge, a collection member for collecting the particulates, the collection member having a collection surface, wherein the particulates are projected from the lower edge away from the compressible resilient surface onto the collection member when the outer surface of the ramp is compressibly moved across the compressible resilient surface and the particulates reach the lower edge, wherein the space in between the lower edge and the collection member is substantially free of any object redirecting the particulates onto the compressible resilient surface.

In another embodiment the invention is directed to a cleaning implement for removing particulates from a compressible resilient surface, the cleaning implement comprising a first ramp having an outer surface for pressing the particulates against the compressible resilient surface when the cleaning implement is moved across the compressible resilient surface in a forward motion of the cleaning implement, the first ramp having a lower edge, a second ramp having an having an outer surface for pressing the particulates against the compressible resilient surface when the cleaning implement is moved across the compressible resilient surface in a backward motion of the cleaning implement, the second ramp having a lower edge, an upper housing operably connected to the first and second ramp such that the housing and the first and second ramps form a substantially hollow space and a collection member for collecting particulates projected from the compressible resilient surface, wherein the collection member is operably connected to the cleaning implement and wherein the collection member comprises a collection surface which does not contact the compressible resilient surface while the cleaning implement is moved across the compressible resilient surface.

In another embodiment the invention is directed to a method of removing particulates from a compressible resilient surface with a cleaning implement comprising at least one ramp having an outer surface for pressing the particulates against the compressible resilient surface, the ramp having a lower edge, and a collection member having a collection surface, the method comprising:

connecting the collection member to the cleaning implement; and compressibly moving the outer surface of the ramp across the compressible resilient surface and against the particulates such that the particulates are projected away from the compressible resilient surface onto the collection surface.

In another embodiment the invention is directed to a disposable collection member for use with a cleaning implement comprising at least one ramp having an outer surface for pressing particulates located on the compressible resilient surface against the compressible resilient surface, and a male or female element located on one side of the cleaning implement, the collection member comprising a disposable substrate having a top surface and a bottom surface, a left portion and a right portion, and an additive applied to the top surface of the disposable substrate, wherein at least one of the left or right portion comprises a corresponding female or male element for being engaged or engaging the male or female element of the cleaning implement, such that the top surface of the disposable substrate is oriented substantially upwards when the disposable substrate is connected to the cleaning implement and the corresponding female or male element is engaged or engages the male of female element located on one side of the cleaning implement.

BRIEF DESCRIPTION OF THE DRAWINGS

While the specification concludes with claims particularly pointing out and distinctly claiming the invention, it is believed that the present invention will be better understood from the following description taken in conjunction with the accompanying drawings in which:

DETAILED DESCRIPTION OF THE INVENTION

Figure 1:
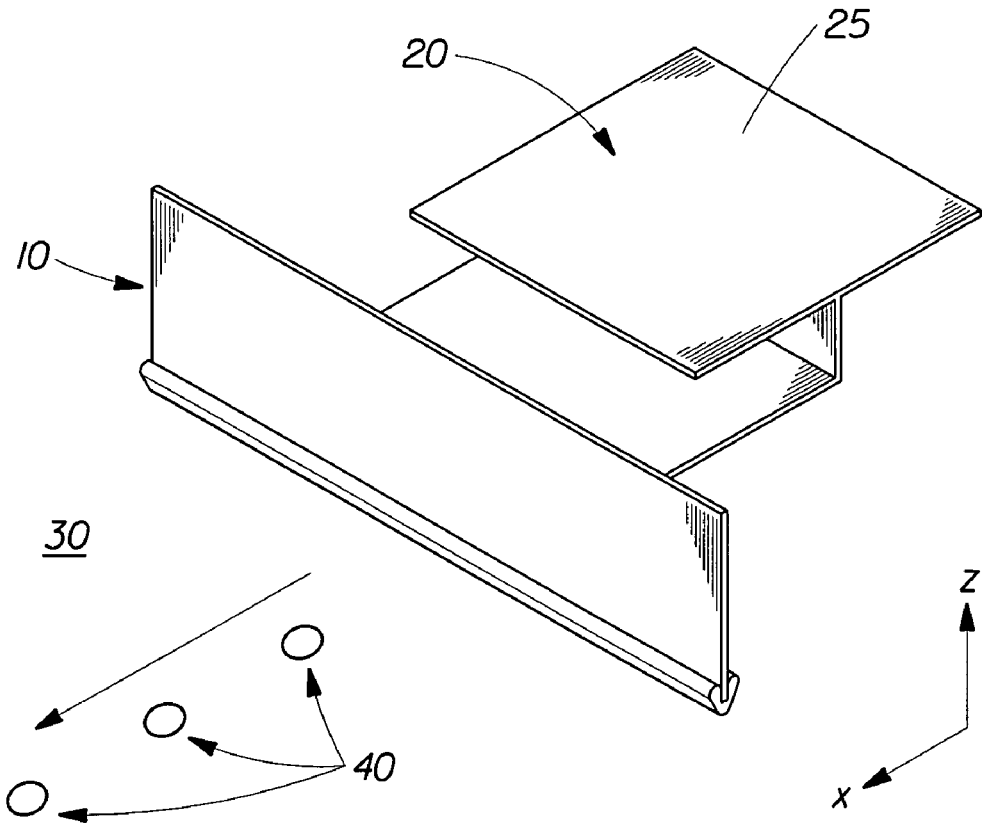
FIG. 1 is a perspective view schematically representing a ramp and a collection member moved across a compressible resilient surface.

All documents cited herein are, in relevant part, incorporated herein by reference; the citation of any document is not to be construed as an admission that it is prior art with respect to the present invention.

It should be understood that every maximum numerical limitation given throughout this specification will include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

All parts, ratios, and percentages herein, in the Specification, Examples, and Claims, are by weight and all numerical limits are used with the normal degree of accuracy afforded by the art, unless otherwise specified.

While not intending to limit the utility of the cleaning implement herein, it is believed that a brief description of its use in association with a collection member will help elucidate the invention.

Numerous devices are known to clean compressible resilient surface such as carpets. The most common are vacuum cleaners and carpet sweepers. Vacuum cleaners remove particulates by generating a negative pressure or suction flow on an area that is adjacent to the carpet, generally on top of the carpet. Their ability to remove these particulates depends at least in part on the power of the electric motor used to generate this negative pressure. As a result, the most powerful vacuum cleaners require to be plugged to an electrical outlet during the whole cleaning operation.

Typical carpet sweepers remove soils via of a rotative brush or blade, which throws or kicks particulates into a collection bin. The ability of the sweepers to remove particulates depends in part on the rotational speed of the brush or the blade. As a result, electrically powered versions of the sweepers are often more effective at cleaning carpets. However, powered carpet sweepers have the same disadvantage as a vacuum cleaner, in the sense that they require a connection to an electrical outlet or to be powered via a battery. In addition, the rotative brush of a sweeper can damage the carpet over time.

The cleaning implement of the invention offers to a user the ability to easily, effectively and hygienically remove particulate soils, or debris and/or soils capable of entanglement from a carpet, cushion or any other compressible resilient surface (herein after "CRS") without requiring a mechanical or electrical source of power. The cleaning implement takes advantage of the compressibility and resiliency of the surface being cleaned to cause particulates to be projected away from the CRS onto a collection member which can be emptied or disposed of at the end of the cleaning operation. The cleaning implement also takes advantage of the propensity of soils capable of entanglement such as lint, threads, hair or any other type of fibers, to bundle together to form a three-dimensional fibrous volume as they are disentangled from a CRS.

The cleaning implement includes a ramp for pressing particulates against the CRS when the ramp is compressibly moved across the surface to be cleaned. After the lower edge of the ramp passes on top of the particulates, the surface, which has been compressed, returns to a relaxed state and projects the particulates away from the surface being cleaned and onto a collection member.

Without intending to be bound or limited by any theory, the basic principle of the invention is schematically represented in FIGS. 1-6.

FIG. 1 shows a schematic perspective view of a ramp 10 and a collection member 20 that is operably connected to the ramp. In a preferred embodiment, the collection member 20 is operably connected to the ramp 10 such that the collection member 20 is substantially statically connected to the ramp 10. By "statically connected", it is meant that the collection member 20 moves in substantially the same direction at substantially the same speed as the ramp 10. The ramp 10 is compressibly moved across a CRS 30 in order to project particulates 40 seating on top of the surface 30.

Figure 2:
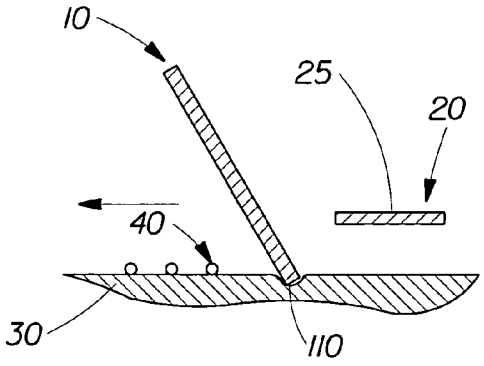
FIG. 2 is a cross-sectional view of the ramp and collection member of FIG. 1 at a first stage.

FIGS. 2-6 are schematic cross-sectional views of FIG. 1 shown at five different stages. FIGS. 1 and 2 both show the ramp 10 whose lower portion is compressibly applied against the CRS. When a substantially downward force is applied to the ramp 10, the lower portion of the ramp deforms the CRS in an area adjacent to this lower portion. When the ramp 10 is moved across the CRS, for example in the direction indicated by the straight arrow shown in FIGS. 1 and 2, while maintaining the substantially downward force, the portion of the CRS previously compressed returns to its original relaxed state due at least in part to its resiliency and a new portion of the CRS is now being compressed by the lower portion of the ramp. By way of analogy, the compressed portion of the CRS can be viewed as a compressed spring which "bounces back" when pressure ceases to be applied to the spring.

Figure 3:
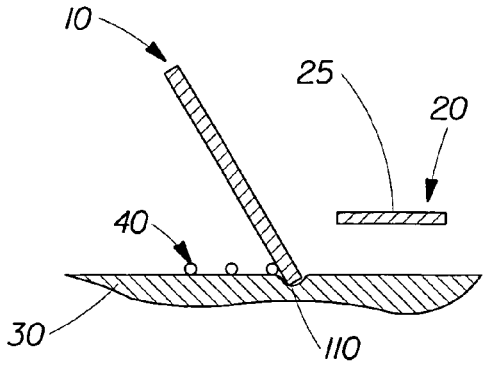
FIG. 3 is a cross-sectional view of the ramp and collection member of FIG. 1 at a second stage.

FIG. 3 shows the ramp 10 which has been moved towards the particulates 40 such that it is now adjacent to one of the particulates 40 and the lower portion of the ramp which is compressibly deforming the portion of the CRS is adjacent to this particulate.

Figure 4:
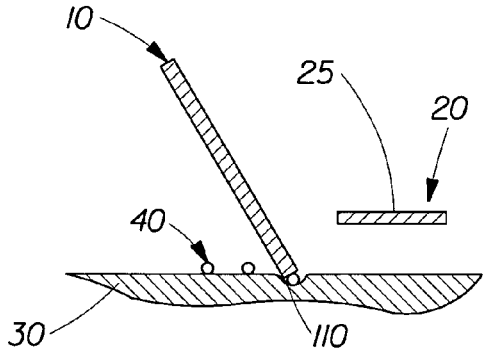
FIG. 4 is a cross-sectional view of the ramp and collection member of FIG. 1 at a third stage.

FIG. 4 shows that when the ramp is moved further in the direction of the particulates 40, the particulate, which was previously adjacent to the lower portion of the ramp, is now being pressed against the CRS underneath the ramp 10.

Figure 5:
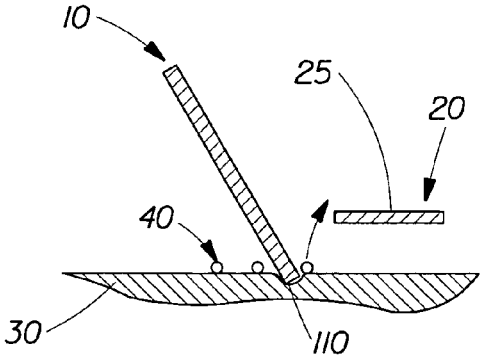
FIG. 5 is a cross-sectional view of the ramp and collection member of FIG. 1 at a fourth stage.

FIG. 5 shows that when the ramp 10 is moved even further across the CRS such that the first particulate passes underneath the lower edge 110 of the ramp 10, this particulate is projected away from the CRS by the previously compressed portion of the CRS returning to its original relaxed state. This first particulate is projected substantially away from the ramp 10.

Figure 6:
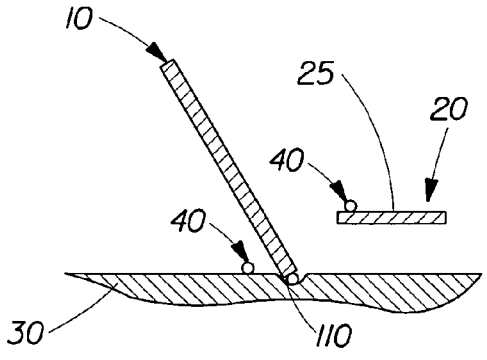
FIG. 6 is a cross-sectional view of the ramp and collection member of FIG. 1 at a fifth stage.

FIG. 6 shows the ramp 10 which is pressing the second particulate against the CRS and the first particulate which has been projected onto a collection surface 25 of the collection member 20.

One skilled in the art will understand that when a particulate is pressed against the CRS, the area of the CRS adjacent to the particulate is deformed. When downward pressure ceases to be applied against this particulate (for example when the ramp is moved toward another portion of the CRS), the portion of the CRS previously compressed by the ramp and the particulate can "spring" or "bounce" back to its original relaxed state and, as a result, it projects the particulate away from the CRS.

Figure 7:
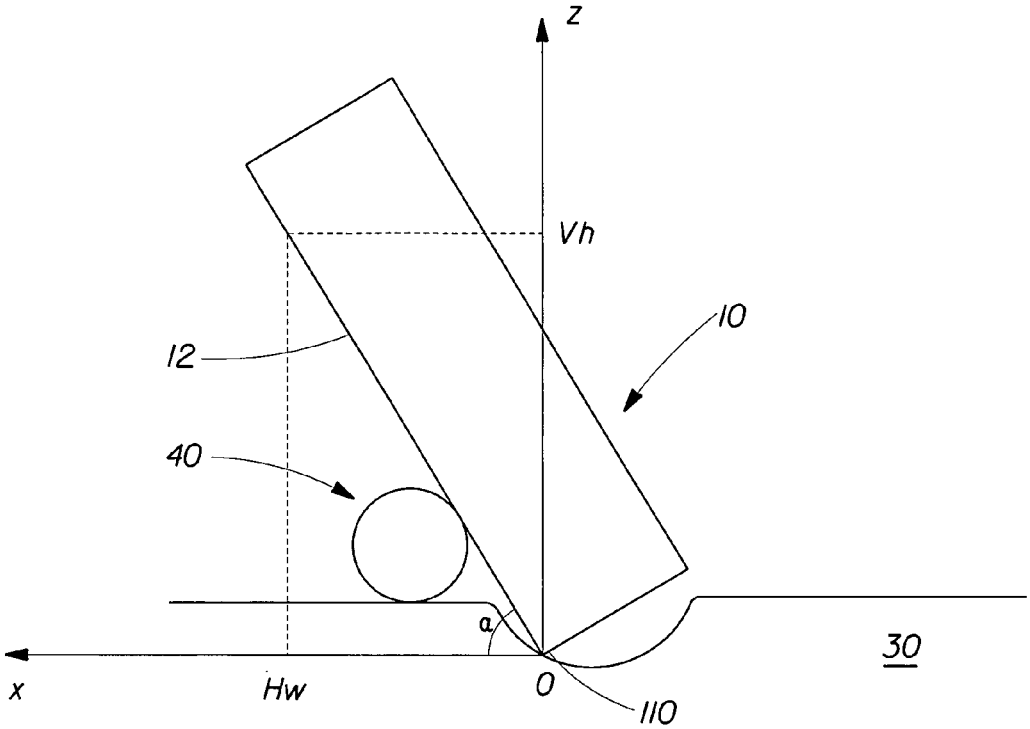
FIG. 7 is an enlarged cross-sectional view of the ramp of FIG. 3.

FIG. 7 is an enlarged cross-section view in a vertical plane of the lower portion of the ramp 10, the CRS 30 and a particulate 40 in contact with the ramp.

The inventors have found that surprisingly the tangential angle $\alpha$ of the ramp relative to the CRS has an impact on the ability of the ramp to press particulates against the CRS and the ability of the ramp to pass on top of the particulates as opposed to simply push or plow particulates in front of the ramp. Without intending to be bound or limited by any theory, it is believed that the tangential angle formed by the tangent of the ramp at the point where the particulate contacts the ramp and the projection this tangent on the horizontal plane impacts the ability of the ramp to press particulates as opposed to push or plow these particulates.

In other words, the inventors have found that surprisingly for certain values of the tangential angle α, particulates, and particularly large particulates are pushed in front of the ramp while for other values of the tangential angle α, the ramp is able to pass on top of the particulates. By "large particulates" it is meant three-dimensional particulates having at least one dimension greater than about 2 mm.

For the sake of clarity and simplicity, a (O, x, z) referential system (i.e. orthogonal x and z axis in a vertical plane) is represented in FIG. 7 with a referential O located on the tip of the lower portion of the ramp. The tip of the lower portion of the ramp is generally the "lowest" point of the ramp engaging the CRS. The tangential angle α is obtained for any point located on the outer surface 12 of ramp 10 by measuring the angle between the tangent to a point of the outer surface 12 (and located in the (O, x, z) plane) and the (O; x) axis. In this referential system, it is possible to measure a vertical height Vh (projection on the z axis) and a horizontal width (projection on the x axis) of any point located on the outer surface 12 of the ramp or between two points located on the outer surface 12 of the ramp by calculating their coordinates in the (o, x, z) plane. As a result, it is possible to characterize the outer surface of the ramp with the vertical height and horizontal width of one or more points located on this surface.

In one embodiment, the cross-sectional shape of the outer surface of the ramp in the (O, x, z) plane (i.e. the plane substantially perpendicular to the CRS) is such that the ramp has at least one tangential angle of less than about 70 degrees, preferably less than about 60 degrees, more preferably less than about 50 degrees and even more preferably less than about 45 degrees when measured at a vertical height of the outer surface of the ramp of between about 2 mm and 30 mm.

In one embodiment, the cross-sectional shape of the outer surface of the ramp in a vertical plane is such that the ramp has at least one tangential angle of less than about 70 degrees, preferably less than about 60 degrees, more preferably less than about 50 degrees and even more preferably less than about 45 degrees when measured at a vertical height of the outer surface of the ramp of between about 3 mm and 15 mm.

One skilled in the art will appreciate that when the outer surface of the ramp is substantially flat, the tangential angle at any point of the outer surface is substantially the same.

In one embodiment, the outer surface of the ramp is curved.

Figure 8:
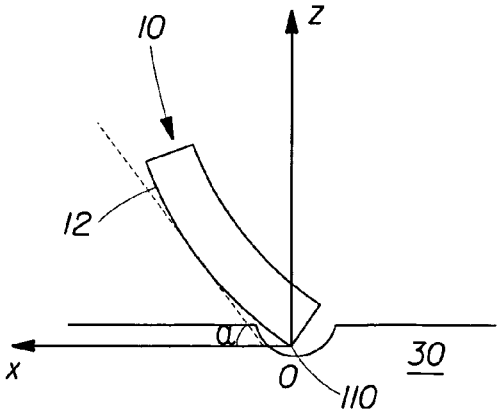
FIG. 8 is an enlarged cross-sectional view of a convex ramp.

In one embodiment shown in FIG. 8, the outer surface of the ramp is convex and the tangential angle α decreases continuously from the top portion toward the lower portion of the ramp.

Figure 9:
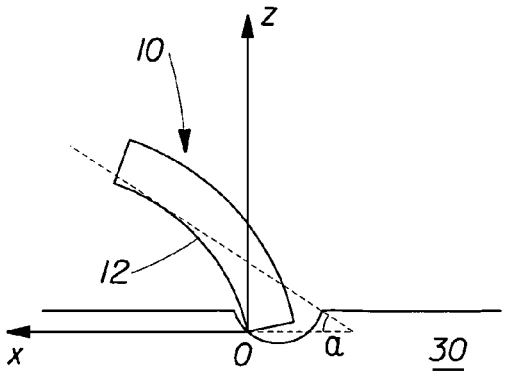
FIG. 9 is an enlarged cross-sectional view of a concave ramp.

In one embodiment shown in FIG. 9 the outer surface of the ramp is concave and the tangential angle α increases continuously from the top portion toward the lower portion of the ramp. In this embodiment, it is preferred that the cross-sectional shape of the outer surface of the ramp in a vertical plane is such that the tangential angle of the ramp at the lower edge (i.e. at the referential O) is less than about 70 degrees, preferably less than about 60 degrees, more preferably less than about 50 degrees and even more preferably less than about 45 degrees.

It will be understood that the outer surface of the ramp can have others and/or more complex shapes and still provide the same benefits.

In one embodiment, the ramp is substantially rigid. By "substantially rigid" it is meant that the ramp is rigid enough to compressibly deform a CRS when the lower portion of the ramp is applied against the CRS and a downward force is applied to the ramp. However, it will be understood that the ramp itself or a portion of a ramp can be deformable and still provide the same benefits.

One skilled in the art will understand that when different ramps are placed against the same CRS and the same downward force is applied to these ramps, the deformation of the CRS depends at least partially on the total area of the outer surface of the ramps which is in contact with the CRS. Consequently, the most deformation is theoretically obtained when only the lower edge (i.e. a line) is in contact with the CRS. Conversely, the least amount of deformation is obtained when the whole flat outer surface of the ramp is able to contact the CRS. Since the ability of a CRS to project particulates depends at least partially on the amount of deformation the ramp is generating, it is preferable to control and/or limit the area of the outer surface of the ramp which is in contact with the CRS during the cleaning operation.

In one embodiment, the cross-sectional shape of the outer surface of the ramp in a vertical plane is such that the ramp has an horizontal width Hw of between about 5 mm, and about 100 mm, preferably of between about 10 mm and about 80 mm and more preferably of between about 15 mm and about 60 mm when measured at a vertical height of the outer surface of the ramp of between about 2 mm and about 40 mm The outer surface of the ramp can be substantially smooth and/or textured.

In one embodiment, the outer surface of the ramp is substantially continuous. By "substantially continuous" it is meant that the outer surface does not include holes, notches or cuts made through the entire thickness of the ramp.

In one embodiment the outer surface of the ramp is discontinuous. By discontinuous" it is meant that the ramp includes at least one hole, notch or cut made through the entire thickness of the ramp.

Figure 10:
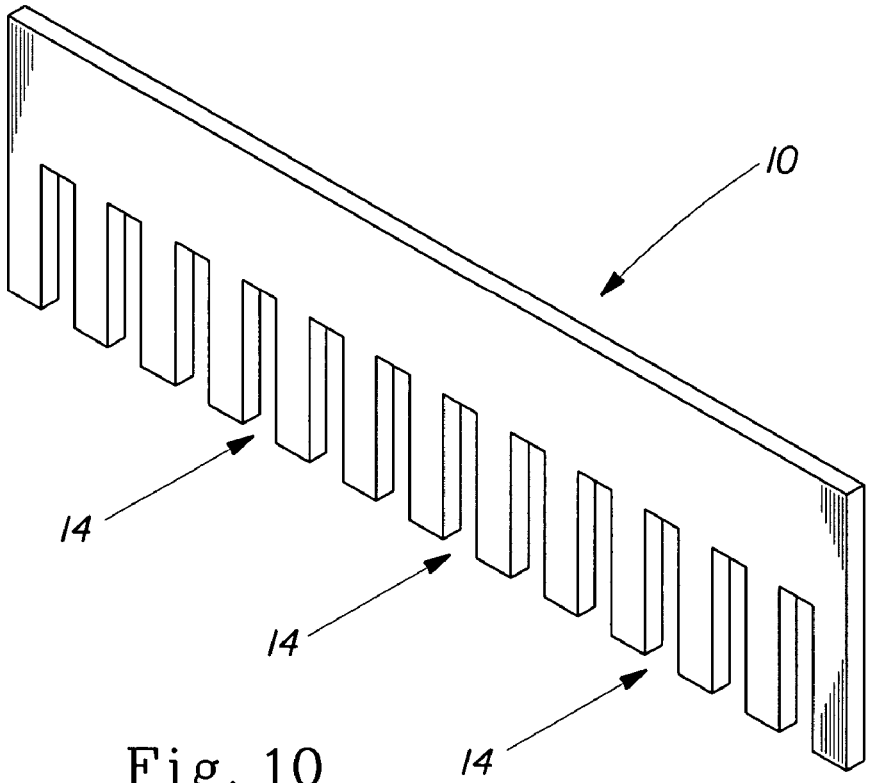
FIG. 10 is a perspective view of another ramp.

FIG. 10 shows a discontinuous ramp having a plurality of cuts 14 made through the entire thickness of the ramp and creating a "teeth" like pattern on the ramp. Among other benefits, such a discontinuous ramp can at least partially penetrate within the CRS in order to extract particulates embedded within the CRS in particular when the CRS is a fibrous surface such as a carpet. In addition, a discontinuous ramp can provide a desirable combing effect to a carpet and also remove substantially two dimensional soils such as hair and the like. Among other benefits, the discontinuous ramp allows for easy removal of hair removed from the CRS by the discontinuous ramp as opposed to a brush where hair gets entangled and enrolled.

It will be understood that aside from the normal inherent deformation of the ramp that is caused by the downward force applied to the ramp and aside from its motion across the CRS, the ramp is substantially static in the (x;z) referential. In other words, the ramp does not rotate in comparison to the rotative brush or blades of a carpet sweeper. In addition, aside from the downward force caused by the own weight of the implement and/or the downward force applied by a user of a cleaning implement including one of the ramps of the invention, it will be appreciated that the ramp does not require any other source of energy provided for example by a motor or gears in order to remove particulates, in particular large particulates from a CRS.

As previously discussed, the collection member is operably connected to the ramp 10 such that it moves in substantially the same direction and at substantially the same speed as the ramp 10.

The inventors have found that the size or volume of the particulates present on the CRS, as well as, the compressability and resiliency properties of the surface being cleaned have an influence on the trajectory and the distance traveled by the particulates projected away from the CRS. The inventors have found that large particulates tend to be projected at a much greater distance than smaller particulates (for example sand, sugar). The inventors have observed that some particulates such as plastic beads having a diameter of about 4 mm were projected up to 200 cm away from their original location on the CRS. The inventors have also observed that a non-negligible amount (i.e. about 50% by weight) of small particulates such as sand sifted to a diameter of between about 0.25 and about 0.5 mm were projected at a distance of less than 20 cm away from their original location on the CRS. Since a CRS such as a carpet typically includes both large and small particulates, it would be prejudicial if the collection member were positioned relative to the lower edge of the ramp such that a large amount of the small particulates were to fall back onto the CRS.

Figure 11:
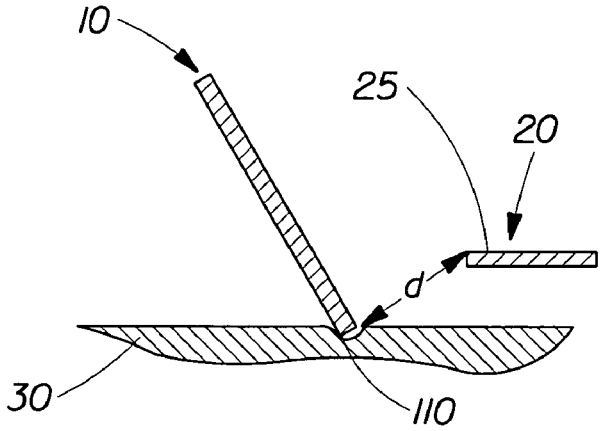
FIG. 11 is a schematic cross-section view of a ramp and a collection member.

In one embodiment shown in FIG. 11, the shortest distance d between the lower portion of the ramp 10 and the collection surface 25 is between about 1 mm and about 200 mm, preferably between about 2 mm and about 150 mm, more preferably between about 5 mm and about 100 mm.

As previously discussed, it has been observed that large particulates tend to be projected at a greater distance than small particulates. Consequently, it would be prejudicial to the cleaning performance of the cleaning implement and the consumer perception if some of the large particulates were to be projected past the collection member. Although the collection member can be made as long as necessary to capture large particulates projected at a long distance, it is preferred to redirect these large particulates toward the collection surface of the collection member. Redirecting large particulates toward the collection surface is achieved when a redirecting element is placed along the path of the large particulates such that these large particulates bounce against the redirecting element toward the collection surface.

Figure 12:
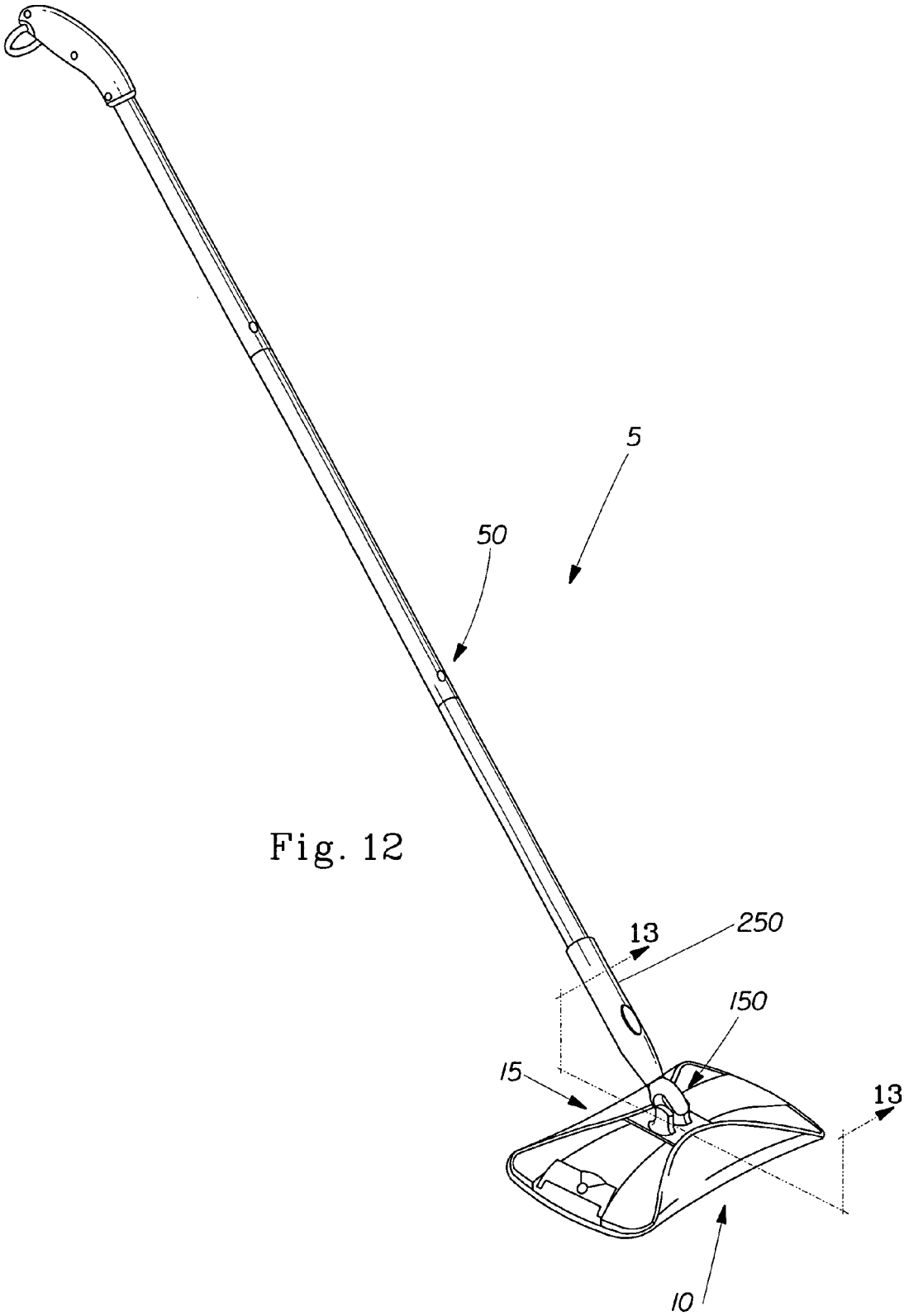
FIG. 12 is a perspective view of a cleaning implement of the invention.

FIG. 12 show a cleaning implement 5 including a ramp, a collection member and a redirecting element of the invention.

In one embodiment, the cleaning implement 5 includes a handle 70, preferably an elongated handle, which is operably connected to the top surface of a housing. In a preferred embodiment, the handle is pivotably connected to the top surface of a housing by a universal joint 150 which allows a user to maneuver the cleaning implement across a CRS.

In a preferred embodiment, the handle 50 is removably connected to a hand grip portion 250 of the universal joint 150 such that the cleaning implement can be used with or without an elongated handle by a user.

Figure 13:
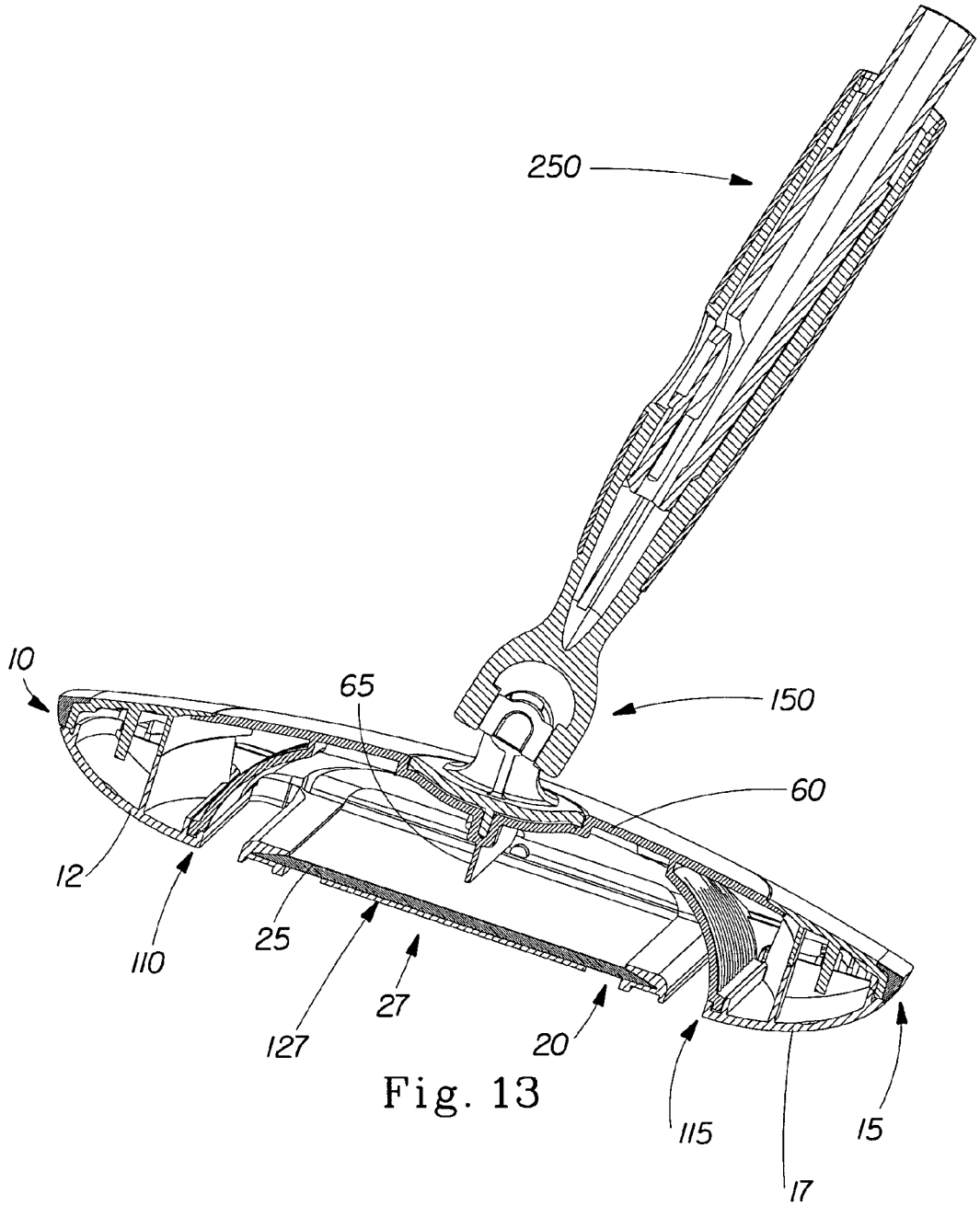
FIG. 13 is a cross-sectional view of the cleaning implement of FIG. 12.

FIG. 13 is a cross-sectional view of the head portion of the cleaning implement of FIG. 12 showing a ramp 10, a collection member 20 and a redirecting element 60.

In one embodiment the redirecting element is an upper housing located substantially above and away from the collection surface such that the upper housing encloses at least partially the collection surface of the collection member. In a preferred embodiment, the housing is connected to the ramp 10. The ramp and housing can be made of any material known in the art providing structure and allowing the ramp to be compressibly moved across the CRS. Non-limiting example of suitable material for the ramp and housing include plastics, such as polyethylenes, polypropylenes, polyesters, polyamides, polyacetals, polyvinyl chloride, or styrene bases polymers, wood, paper, corrugate, ceramic, glass, metal; and any combinations thereof.

In one embodiment, the cleaning implement 5 includes a second ramp 15 that is connected to the housing such that the outer surface 12 of the first ramp 10 and the outer surface 17 of the second ramp 15 are not facing toward the same direction. The second ramp 15 includes a lower edge 115 facing the lower edge 110 of the first ramp 10. Among other benefits, a cleaning implement having a first and a second ramp such that the outer surface of the first ramp and the outer surface of the second ramp are not facing toward the same direction allows a user to use different sides or portion of the cleaning implement to remove particulates from a CRS. In a preferred embodiment, the outer surfaces of the first and second ramps are oriented such that the ramps press particulates alternatively against the CRS. For example, the first ramp 10 presses particulates against the CRS when the cleaning implement is moved forward, and the second ramp 15 presses particulates against the CRS when the cleaning implement is moved backward.

In one embodiment, the collection member 20 is connected (preferably removably connected) to the housing such that the collection member is located in between the first and second ramps. In a preferred embodiment, the collection member is located at substantially equal distance from the first and the second ramp. In a preferred embodiment, the cleaning implement 5 comprises a second redirecting element 65 extending from the inner surface of the housing towards the collection surface. The second redirecting element 65 can be a baffle or a strip extending across the length of the housing. Among other benefits, a second redirecting element reduces the risk that some particulates projected from the lower edge of the first ramp may reach the second ramp (within the enclosed space defined by the first ramp, the housing and the second ramp) and fall back onto the CRS adjacent to the second ramp. In one embodiment, the second redirecting element 65 can also be in contact with the collection member.

In one embodiment, the collection member 20 comprises a collection surface 25 for receiving particulates which have been projected away from the CRS.

In a preferred embodiment, the collection member 20 is operably connected, preferably removably connected, to the cleaning implement such that the collection surface 25 does not contact the CRS during the cleaning operation. Among other benefits, positioning the collection surface such that it does not contact the CRS during the cleaning operation reduces the risk that particulates may fall back onto the CRS.

Figure 14:
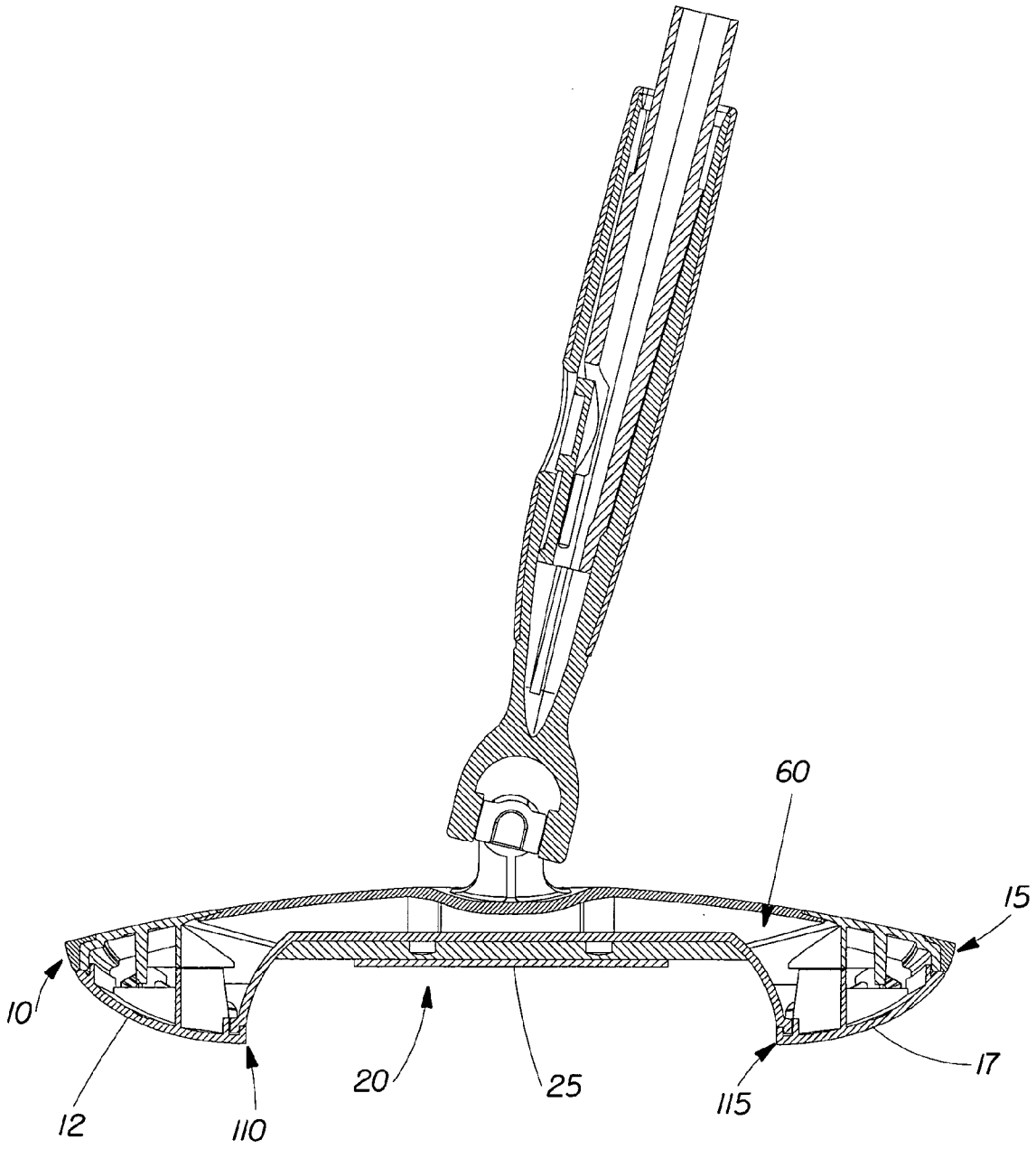
FIG. 14 is a cross-sectional view of another cleaning implement.

FIG. 14 is a cross-sectional view of a cleaning implement with a collection member 20 whose collection surface is oriented substantially towards the CRS (i.e. downward) while not contacting the CRS during the cleaning operation. In this embodiment, it is beneficial to provide the collection surface with means for preventing the particulates to fall back onto the CRS. One example of suitable means for preventing particulates to fall back onto the CRS is an additive applied to at least part of the collection surface and which is capable of enhancing particulate adhesion to the collection surface. In a preferred embodiment, the additive is chosen from at least one of an adhesive, preferably a pressure sensitive adhesive, a wax, a tacky polymer or any mixtures thereof. Non-limiting examples of suitable adhesive or tacky polymer include acrylics, silicon-based materials, rubber-based materials, styrene blockcopolymers, acrylic emulsions, epoxides, PVP-based, cyanoacrylates and the like are among the numerous types of adhesives that can be used.

In one embodiment, the additive for enhancing particulate adhesion and/or for removing or capturing of soils capable of entanglement is applied to a collection surface, either top or bottom, of the collection member at a level of between about 10 g/m$^2$ and about 700 g/m$^2$, preferably between about 20 g/m$^2$ and 500 g/m$^2$ and most preferably between about 40 g/m$^2$ and about 400 g/m$^2$.

Another example of suitable means for preventing particulates to fall back onto the CRS can be pockets formed on the collection surface.

In a preferred embodiment, the collection surface 25 is oriented substantially away from the CRS as shown in FIG. 13. As previously discussed, the collection surface can have means for preventing particulates to fall back onto the CRS. In one embodiment, the means for preventing particulates to fall back is an additive. In another embodiment, the means for preventing particulates to fall back at least one, but preferably a plurality of side walls extending from the outer edges of the collection surface to form at least one bin or a box. The collection surface can also be formed to be concave in order to create a space such that particulates falling into this space are not able to fall back onto the CRS. In one embodiment, the collection surface can include pockets having a top opening for allowing the particulates to fall into a confined space. These pockets have walls which extend from the collection surface and can have any geometric shape knows in the art. In a preferred these pockets have a honeycomb shape. In one embodiment, the collection surface can be corrugated to trap particulates. In one embodiment, the collection surface can be made of or include a substantially porous nonwoven material which can trap particles. Non-limiting examples of suitable porous nonwoven material include batting, high loft materials, nonwoven material having visible pores, foam with visible pores, and any combinations thereof.

In one embodiment, the collection member is removably connected to a cleaning implement including a ramp and is reusable. The collection member is reusable in the sense that at the end of the cleaning operation, a user can simply remove the collection member, empty its content in a trash can and then reconnect the collection bin to the cleaning implement.

In a preferred embodiment, the collection member is removably connected to a cleaning implement and at least a portion of the collection member is disposable. In a preferred embodiment, the portion of the collection member including the collection surface is disposable. In an even preferred embodiment, the whole collection member is disposable. A disposable collection member can be made of any suitable disposable material known in the art. Non-limiting examples of suitable materials include woven or nonwoven substrates including fibers, plastic such as polyethylenes, polypropylenes, polyesters, polyamides, polyacetals, polyvinyl chloride, or styrene bases polymers, wood, paper, corrugate, ceramic, glass, foam, or metal, and any combinations thereof. The collection member can include one layer or be a laminate structure having a plurality of layers of the previous material In one embodiment, the cleaning implement comprises a means for capturing and/or removing soils capable of entanglement from the CRS.

Due to the ability of the ramp to project particles, a large amount of the loose soils found on a CRS are removed. It is found that some of the soils capable of entanglement are also projected onto the collection member, but it is also found that some of these soils are too entangled to the CRS to be projected by the ramp as previously discussed.

Typical cleaning implements capable of removing soils from a CRS, such as for example adhesive carpet rollers, attempt to remove of both loose soils and soils capable of entanglement without separating these soils. The inventors believe that it can be more effective to separate these soils during the cleaning operation of a CRS.

In one embodiment, the means 127 for removing and/or capturing soils capable of entanglement (which are substantially two dimensional soils such as hair) is located on the bottom surface 27 of the collection member 20 as shown in FIG. 13 and the top surface of the collection member can include a collection surface 25 for capturing loose soils (i.e. substantially three-dimensional particulates). In one embodiment, the means 127 for removing and/or capturing soils capable of entanglement is an additive, preferably a tacky polymeric additive, such as a pressure sensitive adhesive or a tacky polymer that is applied to at least a portion of the bottom surface of the collection member. In this embodiment, it is preferred that the collection member is operably connected to the housing such that the bottom surface of the collection member is at least adjacent to but preferably in contact with the CRS.

Figure 15:
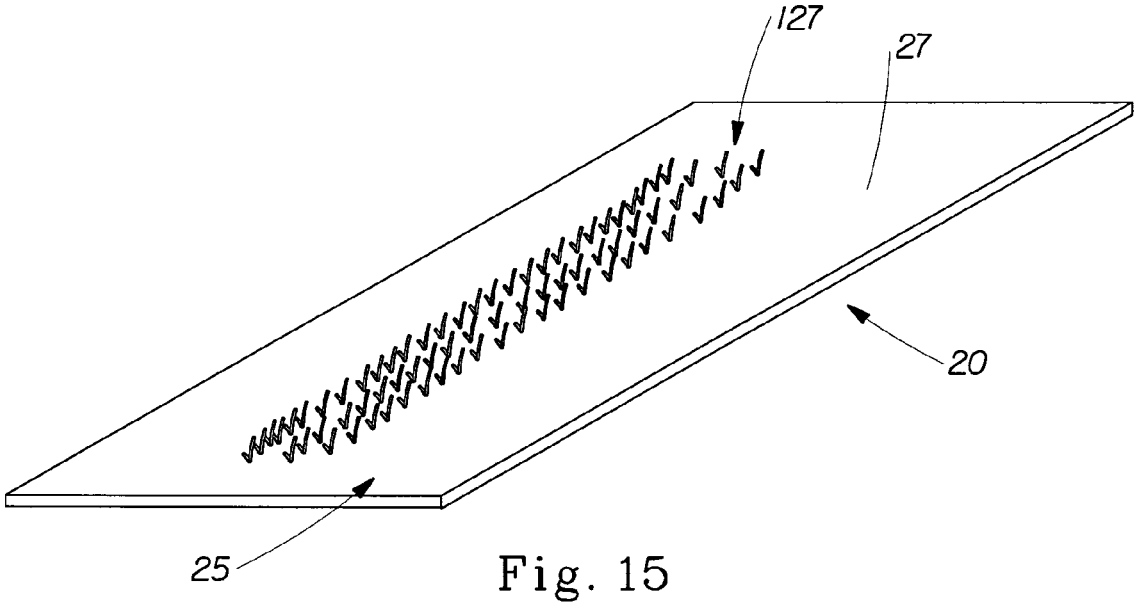
FIG. 15 is a bottom perspective view of a collection member having protrusions.

In a preferred embodiment shown in FIG. 15, the means for removing and/or capturing soils capable of entanglement is a plurality of protrusions extending from, or affixed to, the bottom surface 27 of the collection member such that the protrusions extend toward the CRS during use. Non-limiting examples of projections include hooks made of a plastic material, or protrusions made from plastic films, nonwovens, or paper stock. These protrusions can be made in any shape desired. When the cleaning implement is moved across the CRS, the protrusions or hooks are able to "grab" and remove hair and other substantially two-dimensional soils from the CRS.

In another embodiment, the means for removing and/or capturing soils capable of entanglement can be located on the cleaning implement rather than or in addition to being located on the bottom surface of the collection member. In one embodiment, the front and/or the back edge of the cleaning implement include means for removing and/or capturing soils capable of entanglement. In a preferred embodiment, the means for removing and/or capturing soils capable of entanglement are connected to the implement such that it does not contact the CRS when the bottom of the ramp compresses the CRS. When a user wishes to remove soils capable of entanglement from the CRS, he or she can simply "tilt" or "flip" the head portion of the cleaning implement such that the means can now contact the CRS and remove soils capable of entanglement.

As previously discussed, the collection member is preferably removably connected to the cleaning implement. The collection member can be connected to the implement via any method or mechanism known in the art.

In one embodiment, the collection member is adhesively connected to the cleaning implement. In a preferred embodiment, the collection member is mechanically connected to the cleaning implement.

Figure 16A:
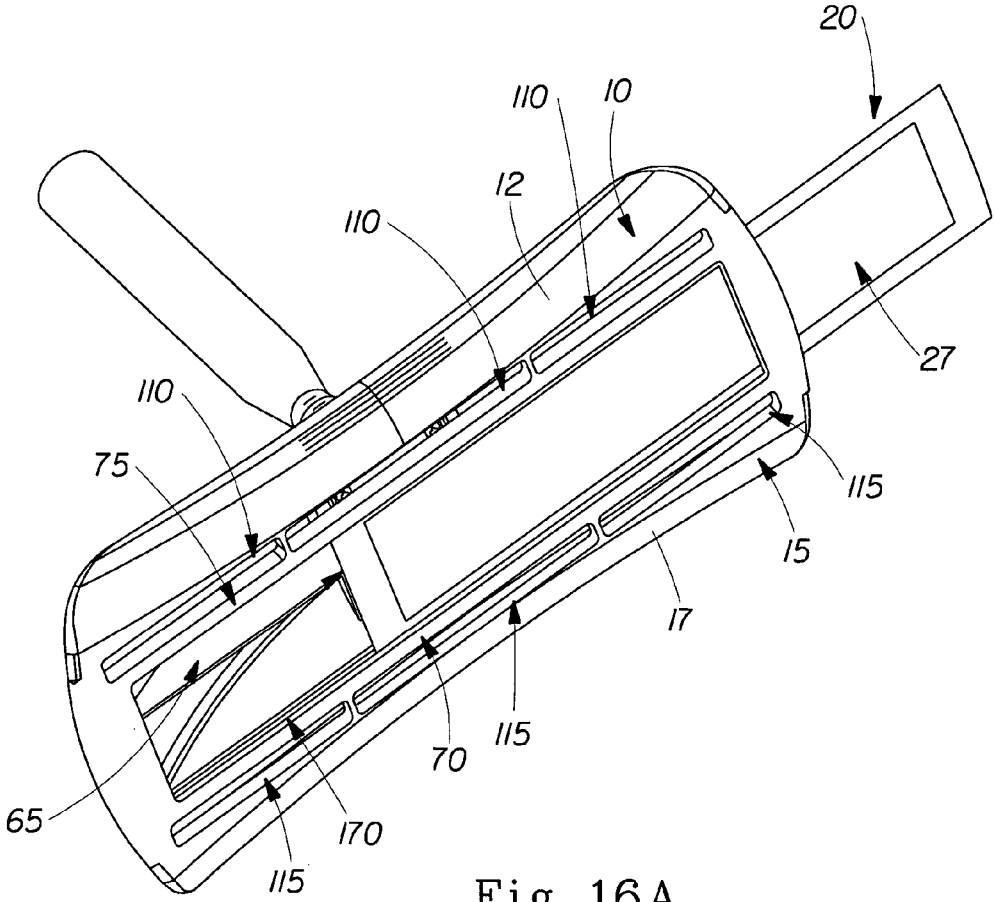
FIG. 16A is a bottom perspective view of the cleaning implement of FIG. 12 showing the collection member partially inserted.

In one embodiment shown in FIG. 16A, the collection member 20 is mechanically connected to the cleaning implement 5 by at least one but preferably two support members 70, 75 which include a groove 170. A user can insert at least a portion of the collection member within at least a portion of the groove(s) 170 such that the collection member moves in substantially the same direction at substantially the same speed as the ramp 10.

Figure 16B:
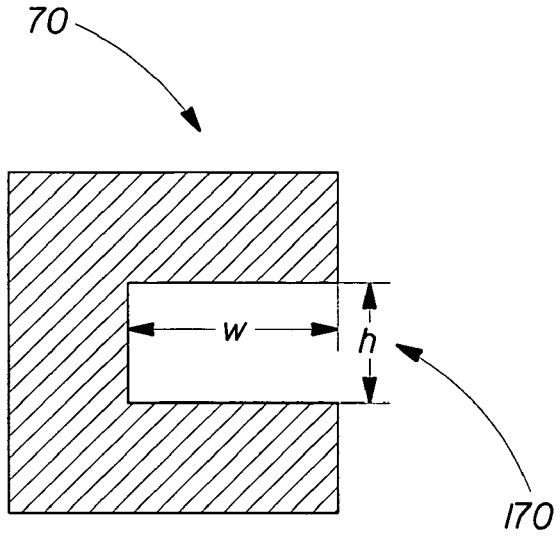
FIG. 16B is a cross-sectional view of a support member.

FIG. 16B is an enlarged cross-sectional view of a support member 70 having a groove 170. In one embodiment, the groove 170 has an "access" height h of at least about 1 mm, preferably of at least about 2 mm, more preferably of at least about 3 mm and of less than about 15 mm, preferably less than about 12 mm, more preferably less than about 9 mm. In one embodiment, the groove 170 has a width w of at least about 1 mm, preferably at least about 5 mm, more preferably of at least about 10 mm. The top and bottom portion of the groove can be substantially parallel, curved or beveled and still provide the same benefits. A user can insert at least a portion of the collection member within at least a portion of the grooves 170 of each support member such that the collection member is maintained connected to the support member of the cleaning implement.

Figure 16C:
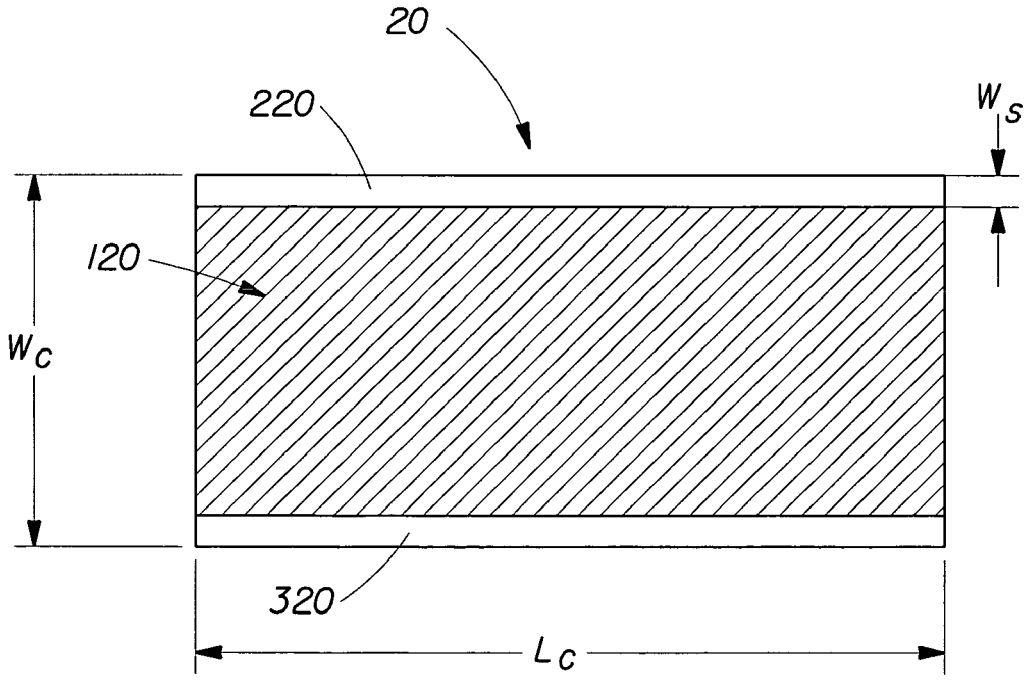
FIG. 16C is a top view of a collection member having an additive.

In one embodiment shown in FIG. 16C, the width Wc of the collection member is such that opposite sides of the collection member can be inserted within the groove of the first and second support members respectively. In one embodiment, the width of the collection member is between about 1 cm and about 30 cm, preferably between about 2 cm and about 25 cm, more preferably between about 3 cm and about 20 cm, even more preferably between about 5 cm and about 15 cm.

In one embodiment, the length of the collection member is between about 5 cm and about 50 cm, preferably between about 10 cm and about 40 cm, more preferably between 15 cm and about 30 cm.

As previously discussed, the collection member 20 can include an additive 120 which is preferably located on the collection surface and/or on the bottom surface of the collection member. In an even preferred embodiment, the additive can be a tacky polymeric additive such as an adhesive or a tacky polymer. In this embodiment, it is preferred that the side portions 220 and 320 of the top and/or bottom surface of the collection member are substantially free of any tacky additive. By "substantially free of any tacky additive", it is meant that the side portion include less than about 10 $g/m^2$, preferably less than about 5 $g/m^2$, more preferably less than about 1 $g/m^2$, and even more preferably less than about 0.5 $g/m^2$ of a tacky additive.

In one embodiment, the side portions 220 and 320 of the collection member, which are substantially free of any tacky additive, have a width Ws of at least about 2 mm, preferably at least about 5 mm, more preferably at least about 10 mm. In one embodiment, the side portion 220 and 320 of the collection member, which are substantially free of any tacky additive, have a width Ws of at less than about 25 mm, preferably less than about 25 mm, more preferably less than about 15 mm. In one embodiment, the side portions have a thickness of between about 0.5 mm and about 2.5 mm, preferably of between about 1 mm and about 2.5 mm.

In one embodiment, the side portions of the collection surface are coated with a tacky additive and are then "poisoned" to prevent the side portion from sticking to the support members. The side portions can be poisoned by the addition of any liquid, solid or powder which reduces the tackiness of the additive.

In another embodiment, the side portions can be coated with a tacky additive and a user can then fold each side portion inwardly such that the folded portions are substantially free of any tacky additive.

Among other benefits, side portions which are substantially free of any tacky additive and/or which have been poisoned allow a user to insert the collection member within the grooves of the support members easily. When the side portions are substantially free of any tacky additive, the side portions can slide easily within the grooves 170 since a tacky additive does not interfere with the insertion of the side portions within the grooves.

Figure 17A:
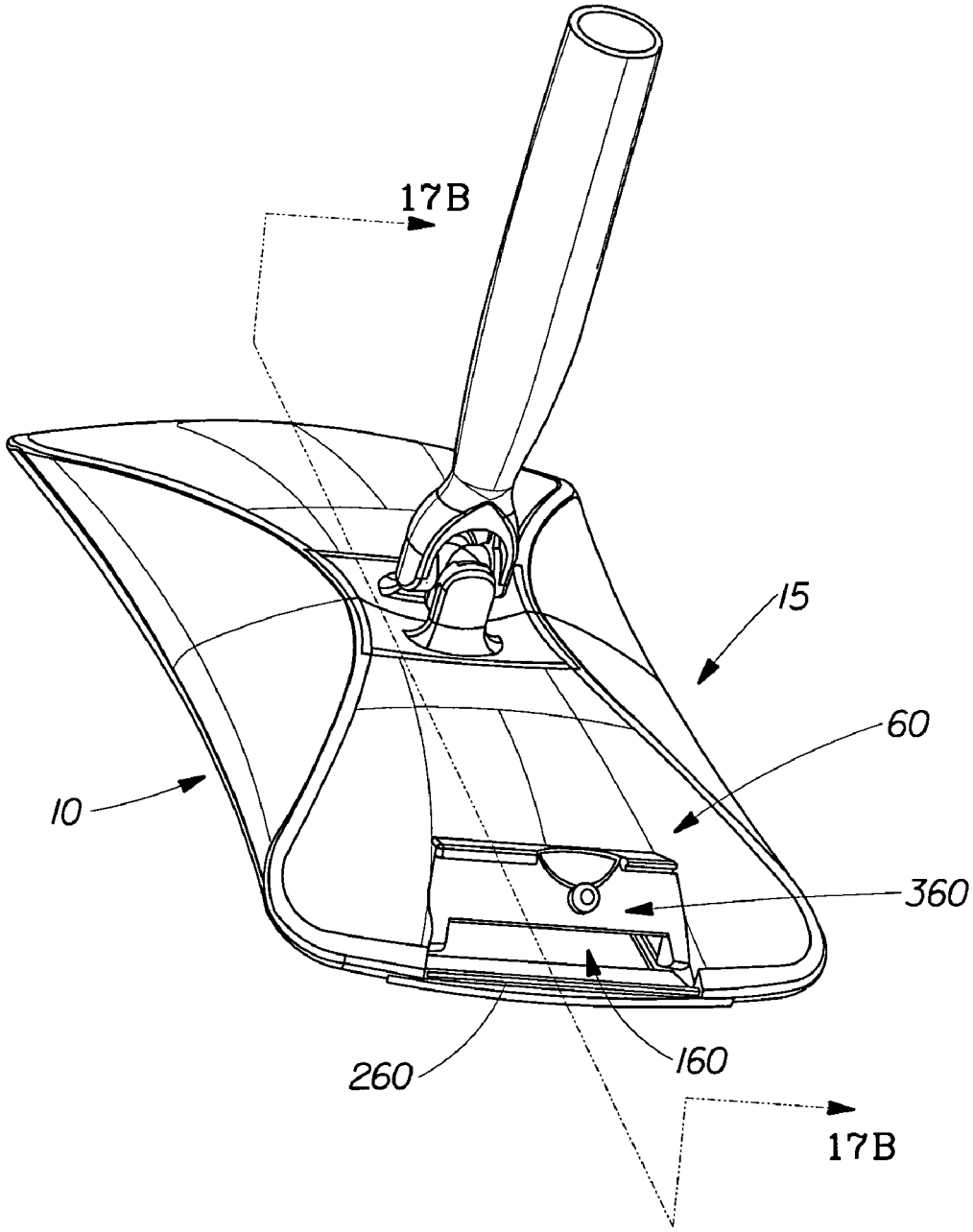
FIG. 17A is a side perspective view of the cleaning implement of FIG. 12.

In one embodiment shown in FIG. 17A, the left and/or right side of the housing 60 include a side opening 160 for inserting a collection member within the space defined by the at least the first ramp and the housing. In a preferred embodiment, only the left or the right side of the housing 60 includes a side opening, the other side being closed to prevent further movement of the collection member in this direction.

In one embodiment, the additive that is present on the collection surface and/or the bottom surface of the collection member can include a dye in order to provide the additive with a color contrasting with the color of the collection surface and/or the bottom surface of the collection member in order to be readily noticed by a user. In one embodiment, the additive can be applied to form a pattern easily noticeable by a user. In one embodiment, this pattern can convey information/instructions to the user on how to properly insert and connect the collection member to the cleaning implement.

In one embodiment, the collection member can optionally include a perfume, a disappearing dye, a dye capable of glowing-in-the dark, an anti-bacterial, fungicide, a pesticide, and any combination thereof.

In one embodiment, any of the additives previously discussed, preferably a tacky additive can be stored in a separate container, such as an aerosol container and the user can be instructed to apply the additive to at least one surface of the collection member.

The collection member can also contain multiple layers of additive separated by at least one release paper or liner to provide a "fresh" collection surface coated with additive.

In one embodiment, the cleaning implement includes an obstructing element 260 for preventing the collection member from accidentally moving out of the cleaning implement when the implement is moved substantially sideways.

Figure 17B:
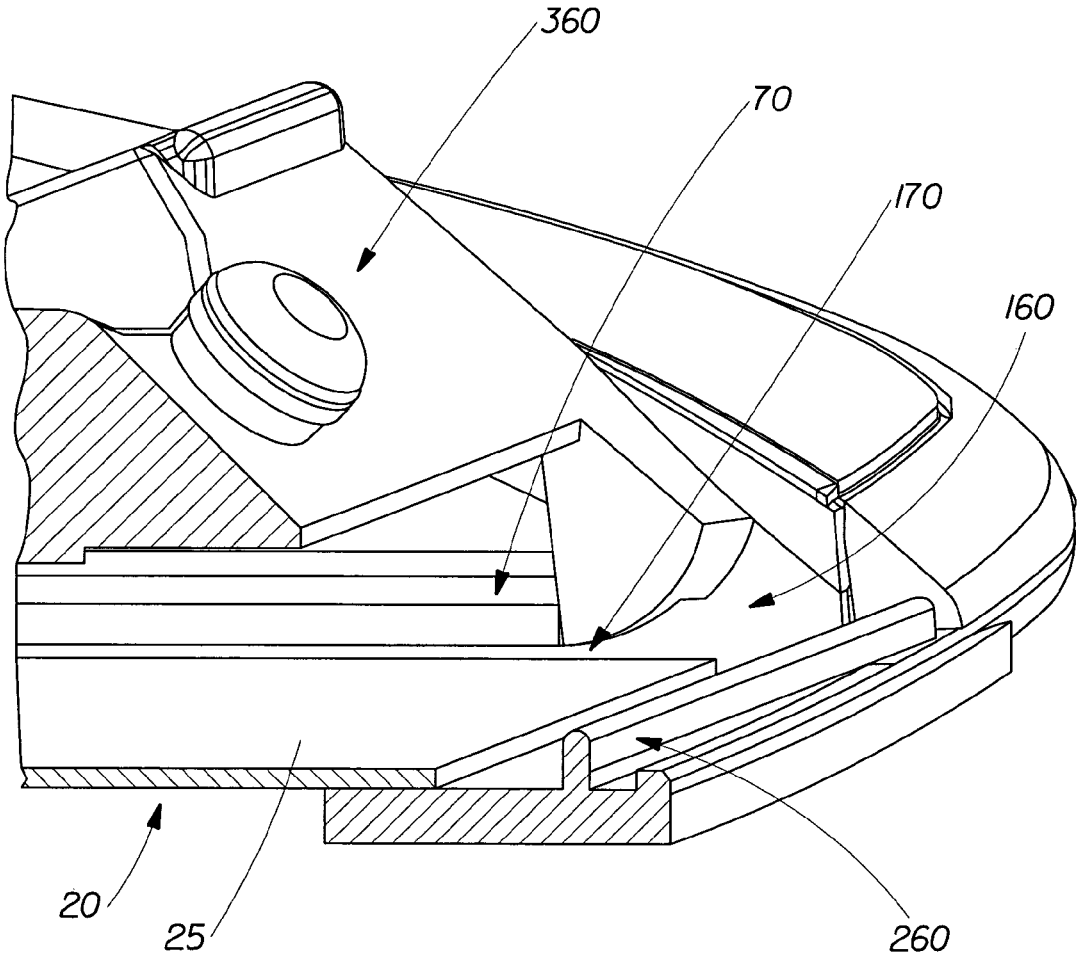
FIG. 17B is an enlarged cross-sectional view of the implement of FIG. 17A.

A cross-sectional view of a support member 70, a collection member 20 inserted within the groove 170 of the support member, and an obstructing element 260 is schematically represented in FIG. 17B. One skilled in the art will understand that without an obstructing member 260, the collection member may slide out of the grooves 160 of the support members when the cleaning implement is moved substantially sideways, more particularly in a direction opposite to the side opening 160 relative to the handle 50. The obstructing element 260 is preferably located away from the proximal ends of the support members 70 and 75, and extends substantially vertically. When the cleaning implement is moved substantially sideways, the collection member can abut against the obstructing element 260, which prevents the collection member from sliding substantially out of the cleaning implement. An obstructing element 260 is especially beneficial when at least a portion of the bottom surface of the collection member 20 is in contact with the CRS during the cleaning operation and when the bottom surface of the collection member includes a tacky additive and/or hook type projections for removing soils capable of entanglement from the CRS. In one embodiment, the length of the obstructing member is less than the width (Ws) of the collection member in order to minimize the contact between the bottom surface of the collection member, and in particular a tacky polymeric additive present thereof, and the obstructing member when the collection member is inserted inside the cleaning implement.

In one embodiment, the proximal portions of the support members 70 and 75 can be curved in order to reduce the risk that the collection member may slide out of the cleaning implement.

The inventors have found that when the bottom surface of the collection member comprises at least one means for removing/capturing soils capable of entanglement, that is in direct contact with the CRS during the cleaning operation, it can be more difficult to move the cleaning implement across the CRS as the means interacts closely with the CRS, resulting potentially in a poor user experience. The inventors have also found that when the bottom surface of the collection member is adjacent to or in direct contact with the CRS, the cleaning efficacy of the means for removing/capturing soils capable of entanglement, more particularly when the means is a tacky polymeric additive, is reduced since the additive on the bottom of the collection member can get "poisoned" very quickly by small particulate of fibrous soils such as dust or small fibers. Furthermore, direct contact of the additive with the CRS can potentially lead to deposition of the additive onto the CRS.

In order to prevent a direct interaction or contact between the bottom surface of the collection member and the CRS, it can be beneficial to have at least a portion of the bottom surface of the collection member, preferably the whole bottom surface of the collection member raised relative to the CRS during the cleaning operation.

Figure 18:
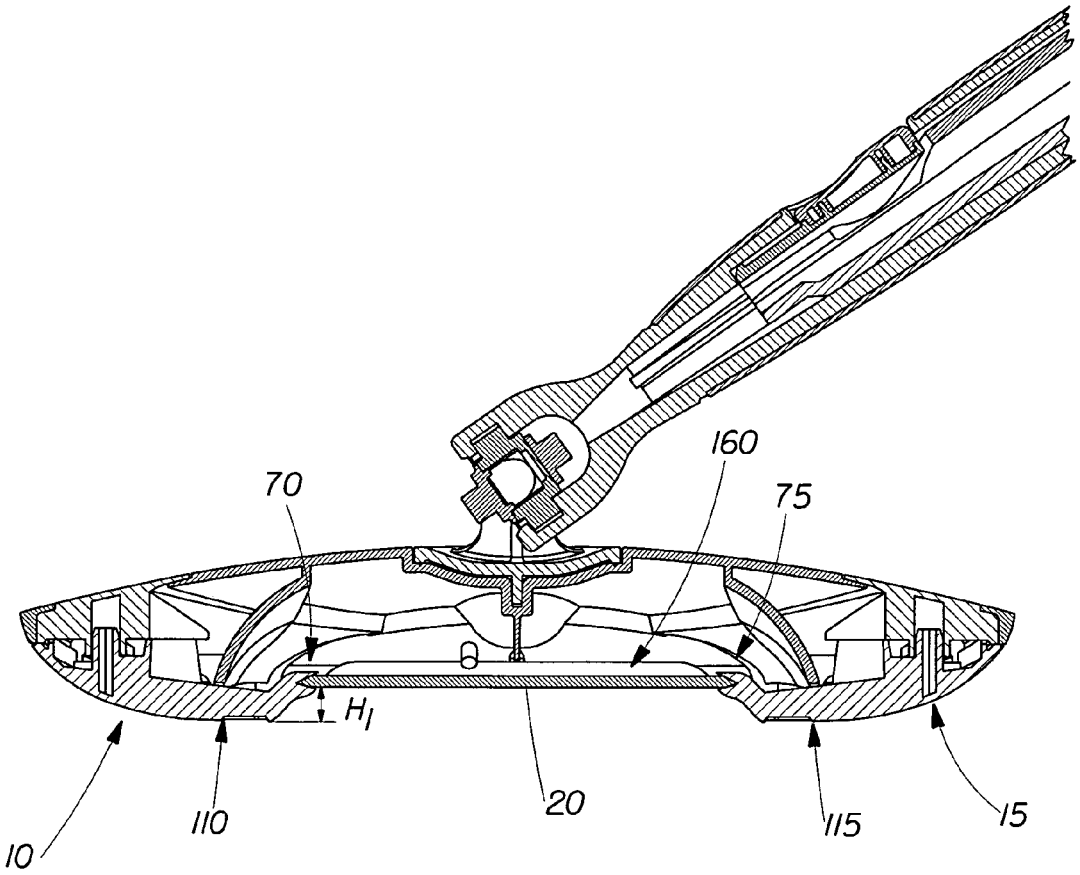
FIG. 18 is a cross-sectional view of another cleaning implement.

FIG. 18 schematically represents a cross-sectional view of one embodiment of a cleaning implement where at least a portion of the bottom surface of the collection member is raised relative to the CRS. In this embodiment, the support members 70, 75 can be connected to the head portion such that the height H1 between the bottom surface of the head portion and the surface which is in contact with the collection member of at least one of the support members is between about 1 mm and about 50 mm, preferably between about 5 mm and about 40 mm, more preferably between about 10 mm and about 30 mm. Ine one embodiment, each support member is located at the same height. In another embodiment, the first support member is closer to the CRS than the second support member.

In another embodiment, at least one, preferably both of the support members 70, 75 can be angled such that the groove 170 projects upward or downward from the CRS. One skilled in the art will understand that when both support members "point" in the same direction, either upwards or downwards, a flexible collection member can take a substantially concave, respectively convex shape relative to the CRS.

Figure 19A:
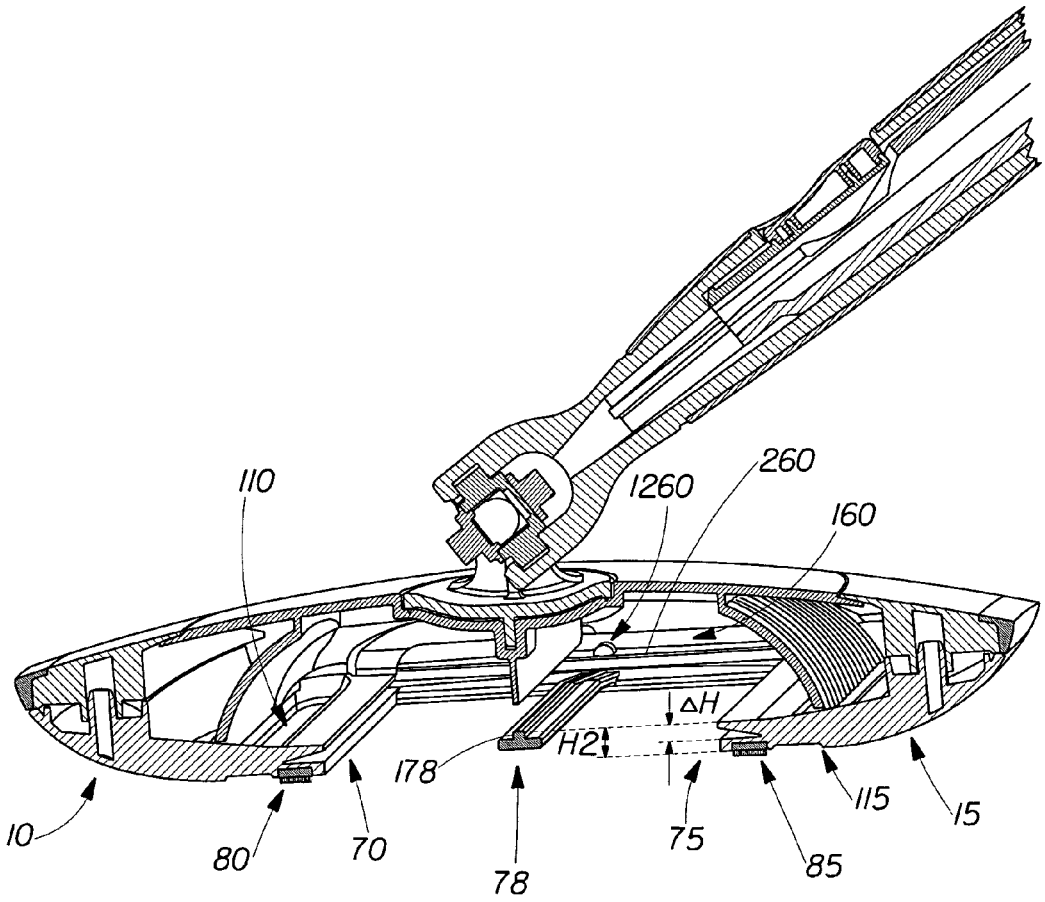
FIG. 19A is an isometric cross-sectional view of a cleaning implement having a height adjustment member.
Figure 19B:
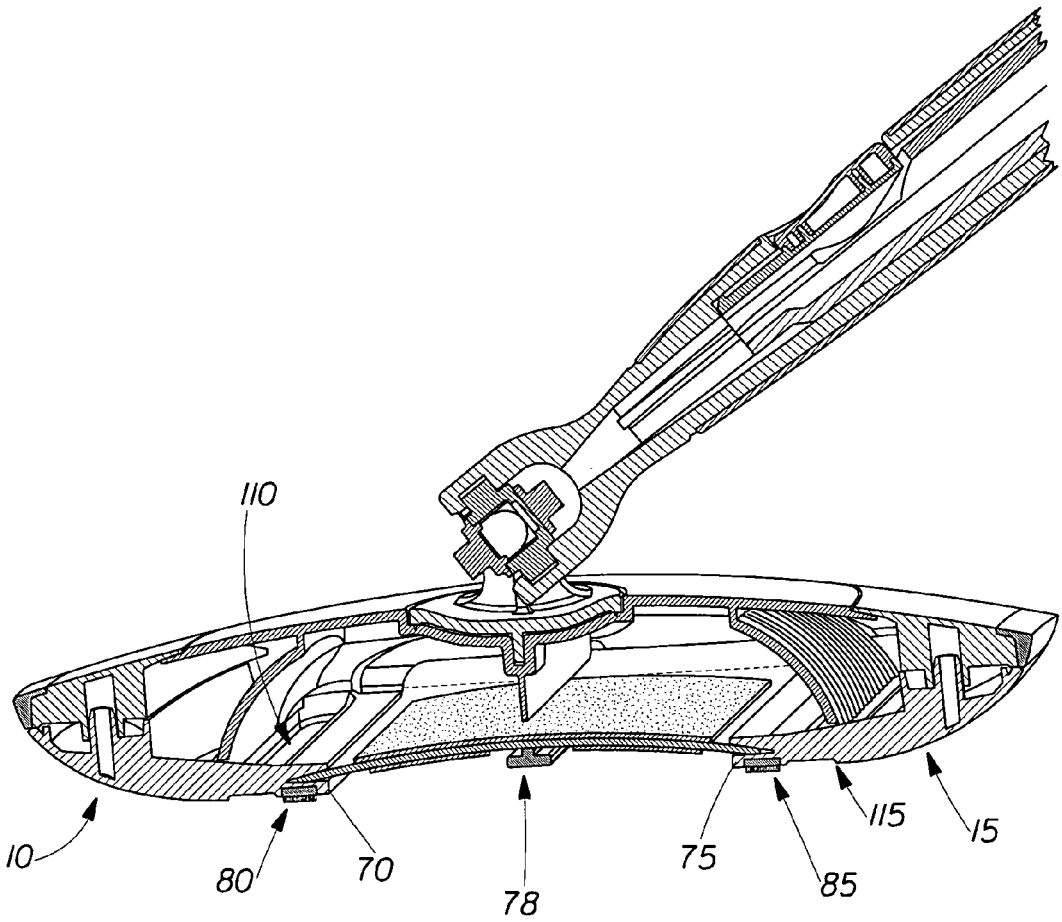
FIG. 19B is an isometric cross-sectional view of the cleaning implement of FIG. 19A having a collection member.
Figure 19C:
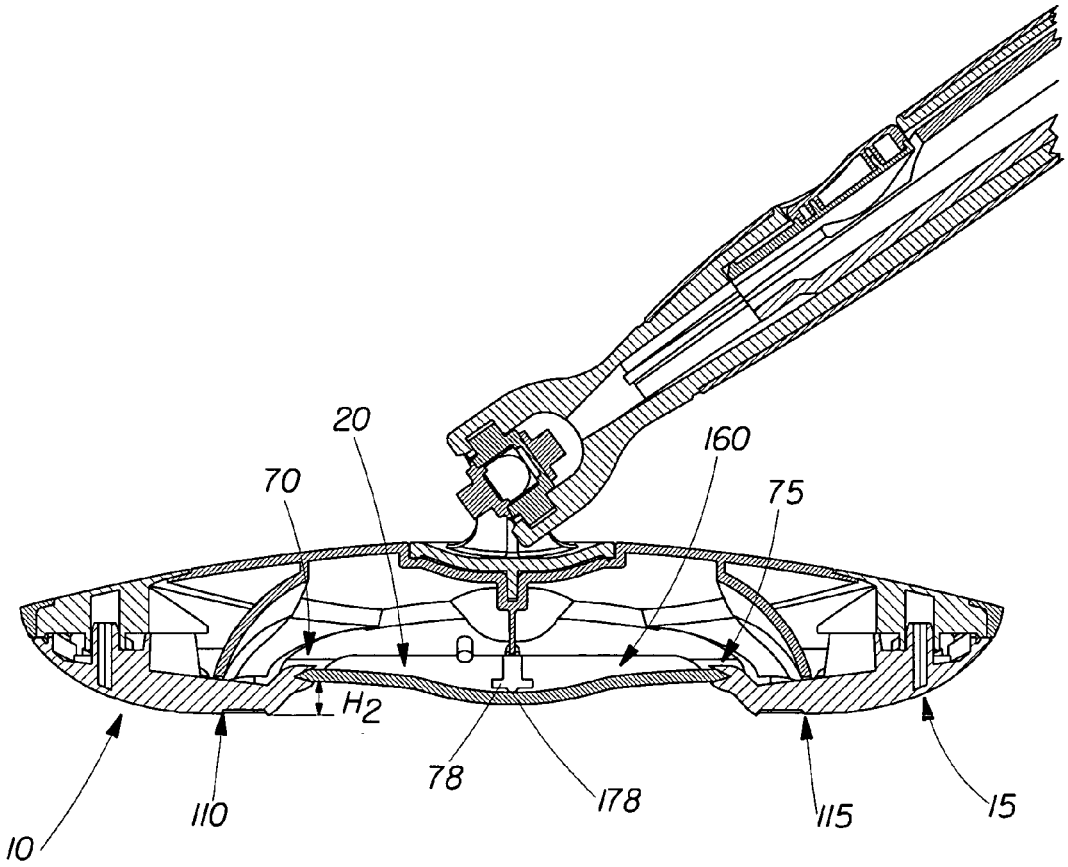
FIG. 19C is an isometric cross-sectional view of a cleaning implement having another height adjustment member.

In one embodiment shown in FIGS. 19A-19D, the cleaning implement can further include at least one height adjustment member 78 for raising or lowering at least a portion of the bottom surface of a collection member. In one embodiment, the height adjustment member 78 extends from the side opening 160 toward the opposite side of the head portion. In a preferred embodiment, the height adjustment member 78 is substantially centered relative to the front and back of the head portion of the implement and the can also be substantially perpendicular to the side opening 160. When a collection member is inserted within the cleaning implement through the side opening 160, the collection member is bent substantially upwards or downwards and takes a concave or convex shape relative to the CRS during the cleaning operation as schematically represented in FIGS. 19A-19C.

The height adjustment member 78 can have any geometric cross-sectional shape. Non-limiting examples of suitable cross-sectional shapes include circular, square and triangular. In a preferred embodiment, the cross-sectional shape of the height adjustment member 78 includes a tip or apex 178, which can be either sharp or rounded, in order to limit the surface available for contact between the height adjustment member and the bottom or top surface of the collection member. One skilled in the art will understand that limiting the surface available for contact between the height adjustment member and the bottom or top surface of the collection member reduces the friction when the collection member is inserted within the cleaning implement, in particular if the bottom and/or top surfaces of the collection member include a tacky polymeric additive. Alternatively or in addition to the height adjustment member having a tip or apex portion, the portion of surface of the collection member which is capable of contacting the height adjustment member 78 can be substantially free of a tacky polymeric additive or can be "poisoned" to facilitate the insertion of the collection member. In another embodiment, the portion which is capable of contacting a height adjustment member 78 of both top and bottom surface of the collection member can be substantially free of a tacky polymeric additive or can be "poisoned", in order to allow a user to insert and remove the collection member.

In one embodiment, the height adjustment member is connected to the head portion such that the height H2 between the portion of the height adjustment member 78 in contact with the collection member and the bottom surface of the cleaning implement is between about 2 mm and about 50 mm, preferably between about 3 mm and about 40 mm, more preferably between about 5 mm and about 30 mm and the height H1 between the bottom surface of the head portion and the surface of at least one of the support member which is in contact with the collection member is between about 1 mm and about 50 mm, preferably between about 2 mm and about 40 mm, more preferably between about 3 mm and about 30 mm FIG. 19B is a schematic cross-sectional view of a head portion in the context of a height adjustment member raising the collection member 20 and FIG. 19C is a schematic cross-sectional view of a head portion in the context of a height adjustment member lowering the collection member.

In one embodiment, the "Height Differential" ΔH between the portion of the height adjustment member 78 capable of contacting the collection member and the surface of at least one of the support member which is in contact with the collection member is between about 1 mm and about 50 mm, preferably between about 2 mm and about 40 mm, more preferably between about 3 mm and about 30 mm.

It will be appreciated that the height adjustment member 78 having a height H2 allows at least a portion of the collection member to be raised away from the CRS or moved closer to the CRS.

Without intending to be bound by any theory, it is surprisingly found that the height H1 and H2 increases the efficacy of the means for capturing/removing soils capable of entanglement at the bottom surface of the collection member as the height adjustment member allows for a less direct contact/interaction between the means for capturing/removing soils capable of entanglement and the CRS.

It will be also appreciated that when a user moves the bottom surface of the cleaning implement against and/or across a CRS in a back and forth sweeping motion, at least some of the soils capable of entanglement, which are present on the CRS and very slightly entangled to the CRS, get in contact with the means for removing/capturing these soils.

It is observed that typical CRS, in particular carpets, can have soils capable of entanglement which are strongly entangled within the carpet fibers and, as a result, require additional mechanical action to get disentangled.

Figure 19D:
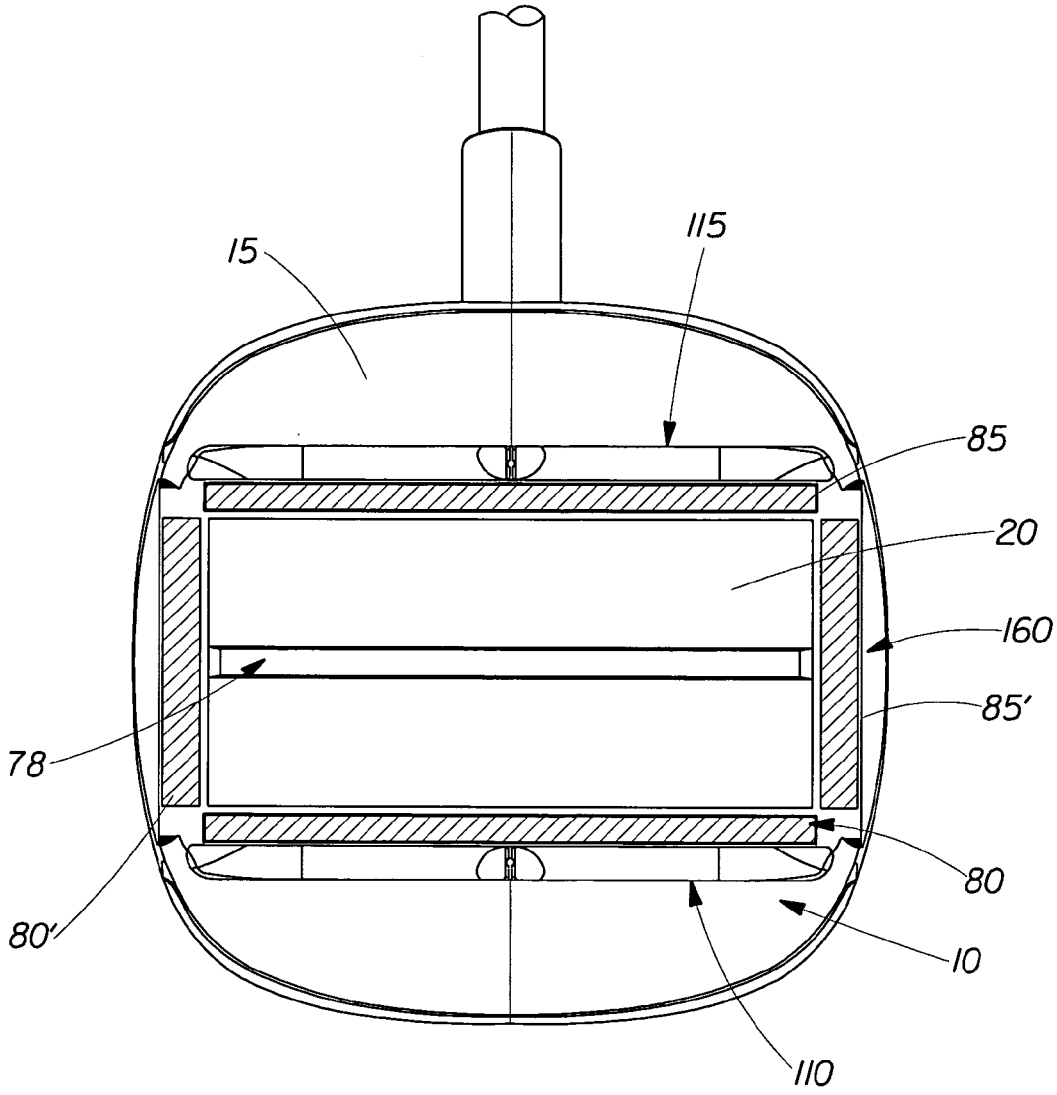
FIG. 19D is bottom view of a cleaning implement having a disentangling member.

In one embodiment shown in FIGS. 19A, 19B and 19D, the cleaning implement includes at least one disentangling member 80 for at least partially disentangling soils capable of entanglement from the CRS. FIG. 19D is a bottom view of the cleaning implement showing a first disentangling member 80 and a second disentangling member 85. By "disentangling member", it is meant any feature, device, mechanism and/or surface capable of pulling and/or grabbing soils capable of entanglement which are strongly entangled within the CRS. Non-limiting examples of suitable disentangling members include protrusions formed or molded on a nonwoven material such as plastic films or cardstock, combs, rakes, woven or formed hooks, bristles, woven fabric, synthetic resin, natural rubber, synthetic rubber, scrim or meshed materials, sand paper, reticulated foam, scouring pads and any combination thereof.

In a preferred embodiment, the disentangling member 80 is unidirectional. By "unidirectional disentangling member", it is meant that the disentangling member is able to grab and/or pull fibrous soils from the CRS when the disentangling member is moved across the CRS in one direction but also that the disentangling member is also able to release at least some, preferably substantially all the then disentangled soils when the disentangling member is moved in an opposite direction across the CRS. Non-limiting examples of suitable unidirectional disentangling members include extruded hooks, slanted fibers, bristles, comb, woven fabric having a surface covered with standing fibers all of which are tilted in one direction, also commonly know as lint brush fabric, and any combination thereof. In a preferred embodiment, the unidirectional disentangling member is a lint brush fabric or material which is available from the Collins & Aikman Corp. of Roxboro, N.C. 27573, under the trade name DE LINT. Suitable lint brush fabric are also disclosed in U.S. Pat. No. 6,763,977B2 and U.S. Pat. No. 4,639,965

In one embodiment, the disentangling member 80 is connected to the head portion of the cleaning implement such that it can engage and at least partially disentangle soils capable of entanglement during the cleaning operation. When soils capable of entanglement are at least partially disentangled from the CRS, they are more easily captured/removed by the bottom surface of the collection member and/or can be projected by the ramp onto the collection surface of the collection member.

In a preferred embodiment, the disentangling member 80 is connected to the bottom surface of the head portion such that it can at least partially disentangle soils capable of entanglement when a user moves the bottom surface of the head portion across the CRS in a back and forth sweeping motion.

In one embodiment, the disentangling member is connected to the bottom surface of the height adjustment member 68.

In one embodiment, the disentangling member is connected to the curved surface of a ramp 10.

In one embodiment, at least one disentangling member 80 is connected to the bottom surface of the head portion such that it is located in between the lower edge of a ramp 10 and the bottom surface of the collection member 20. In a preferred embodiment, the disentangling member 80 is unidirectional and is connected to the bottom surface of the head portion and oriented such that the disentangling member grabs and/or pulls fibrous soils when the head portion is moved across a CRS and the collection member is "leading" relative to the ramp 10 of the front of the head portion (i.e. the head is moved towards the user) and the disentangling member releases the fibrous soils it has disentangled when the ramp or the front portion of the head is "leading" relative to the collection member (i.e. the head is moved away from the user). It will be appreciated that the disentangling member can be located underneath the bottom surface of the collection member, such as for example by being connected to the height adjustment member and oriented as previously discussed, and still provide the same benefits.

In another embodiment, a second disentangling member 85 is connected to the bottom surface of the head portion of the implement. In one embodiment, the second disentangling member 85 is connected to the bottom surface of the head portion of the implement such that it is located in between the lower edge of a second ramp 15 and the bottom surface of the collection member 20. In a preferred embodiment, the second disentangling member 85 is unidirectional and is connected to the bottom surface of the head portion and oriented such that the second disentangling member grabs and/or pulls fibrous soils when the head portion is moved across a CRS and the ramp 10 located in the front of the head portion is "leading" relative to the collection member 20 (i.e. the head is moved away from the user) and the second disentangling member 85 releases the fibrous soils it has disentangled when the collection member 20 is "leading" relative to the front ramp 10 or the front portion of the head (i.e. the head is moved towards the user). It will be appreciated that the second disentangling member 85 can be located underneath the bottom surface of the collection member, such as for example by being connected to the height adjustment member and oriented as previously discussed, and still provide the same benefits.

Without intending to be bound by any theory, it is believed that when a user moves the head portion across a CRS containing fibrous soils (i.e. soils capable of entanglement) in a back and forth sweeping motion, the first and second disentangling members 80, 85 grab/pull fibrous soils and then releases the disentangled fibrous soils in an alternative manner.

Figure 20A:
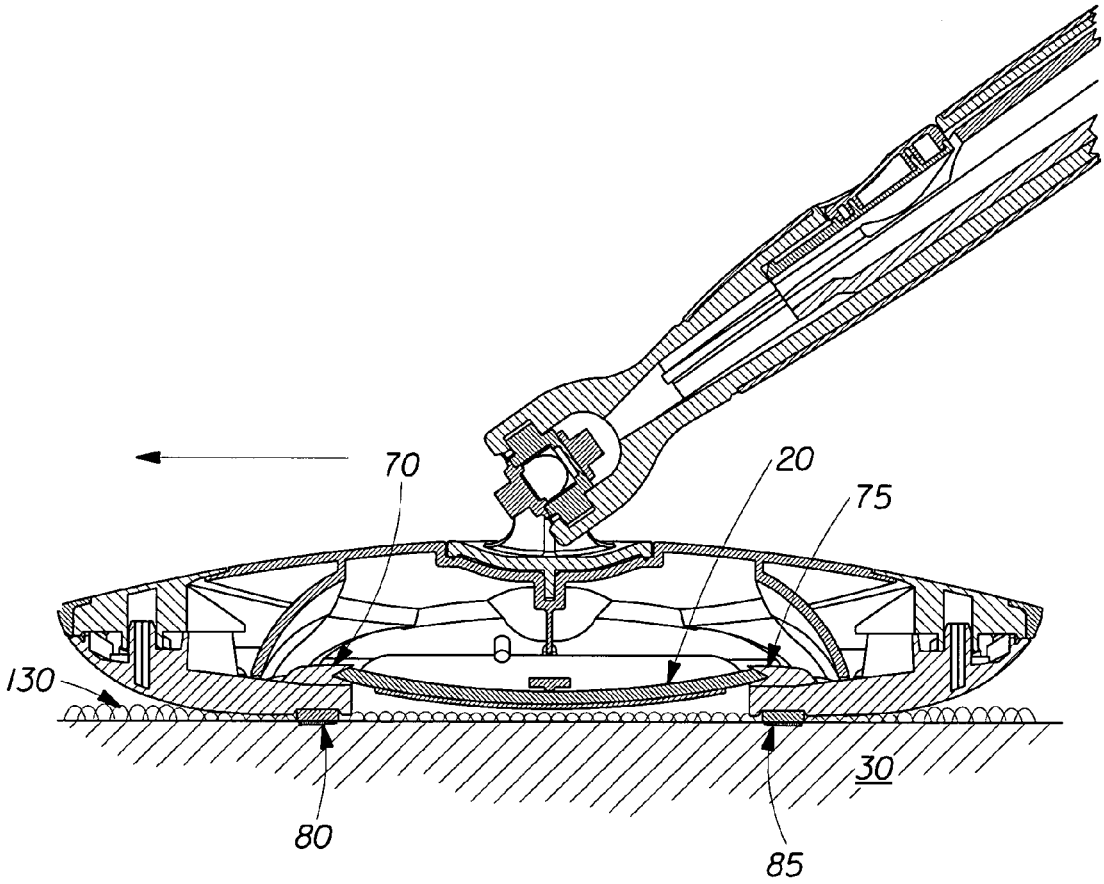
FIG. 20A is a schematic cross-sectional view of a cleaning implement at a first step of the cleaning operation.
Figure 20B:
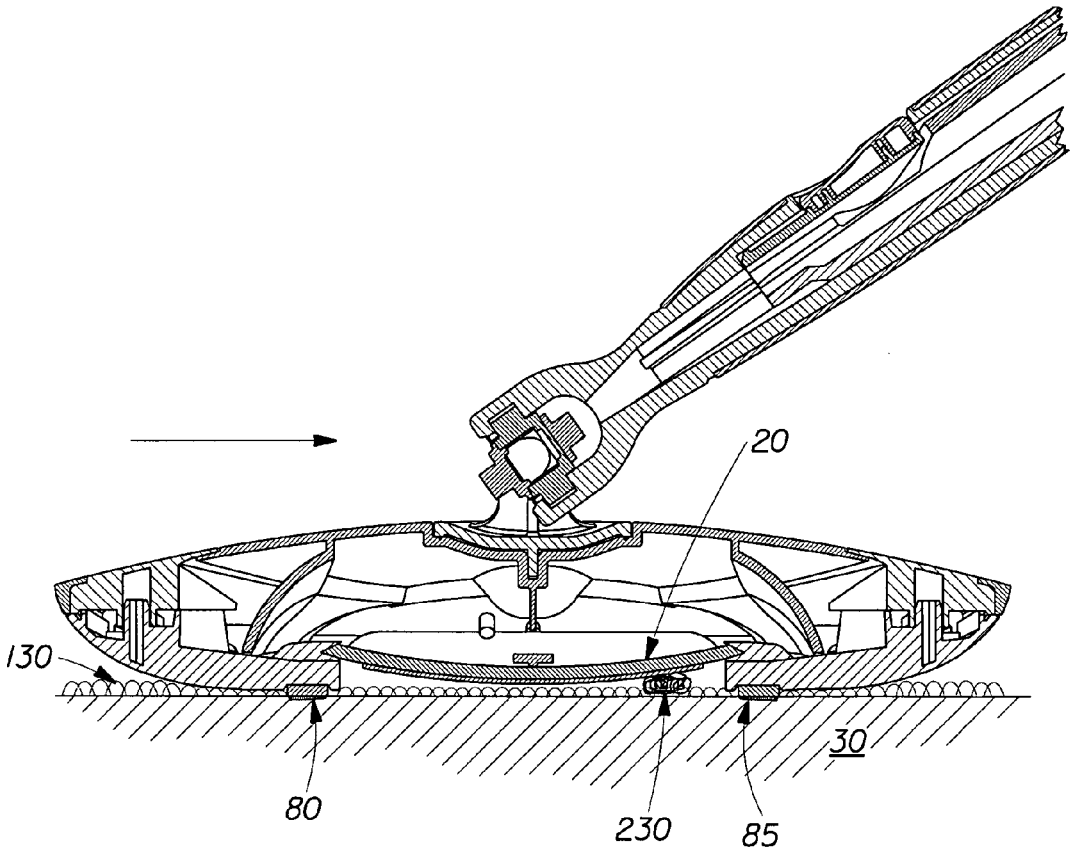
FIG. 20B is a schematic cross-sectional view of a cleaning implement at a second step of the cleaning operation.

The capture/removal process of the soils capable of entanglement is schematically represented in FIGS. 20A-20B.

FIG. 20A schematically represents the head portion being moved forward as indicated by the arrow (i.e. away from the user) against a CRS 30 containing fibrous soils 130. Due to their respective orientations, the first (front) disentangling member 80 moves on top of the fibrous soils 130 without substantially grabbing or pulling these soils and the second (back) disentangling member 85 grabs/pulls the fibrous soils which are collected by the second disentangling member.

FIG. 20B schematically represents the head portion being moved backward as indicated by the arrow (i.e. towards the user) against the CRS, the second disentangling member 85 release the fibrous soils it has previously collected and the first disentangling member 80 is now pulling/grabbing and collecting fibrous soils. Depending on the amount of fibrous soils present on the CRS and that have been collected by the second disentangling member 85, these soils are released in the form of a fibrous bundle 230 having some three-dimensionality. One skilled in the art will understand that if the CRS only includes a relatively small amount of fibrous soils, the fibrous bundle will have little three-dimensionality. Conversely, if the CRS includes a relatively large amount of fibrous soils, a larger amount of fibrous soils are released in the form of a fibrous bundle having more three-dimensionality.

When on the amount of fibrous soils present on the CRS results in a large/voluminous three-dimensional fibrous bundle being released by the second disentangling member, this released fibrous bundle is captured/removed by the means for removing/capturing these soils of the bottom surface of the collection member 20, in particular when the means for removing/capturing these soils is a tacky polymeric additive as shown in FIG. 20B.

When on the amount of fibrous soils present on the CRS results in a small fibrous bundle being released by the second disentangling member, this released fibrous bundle is not captured/removed by the means for removing/capturing these soils of the bottom surface of the collection member 20, but instead, this small fibrous bundle is now collected by the first disentangling member. When a user moves the head portion against the CRS forward, the first disentangling member 80 releases the originally small fibrous bundle together with additional fibrous soils it has collected.

One skilled in the art will understand that during a typical back and forth sweeping motion, fibrous soils are collected and released by the two disentangling members until the size of the fibrous bundle being released is large and/or voluminous enough to be captured by the means for removing capturing these soils of the collection member.

In one embodiment, the cleaning implement can include third and fourth unidirectional disentangling members 80', 85' respectively located to the left and right side of the head portion and oriented such that the disentangling member 80' located on the left side, pulls or grabs fibrous soils when the head is moved towards the right relative to the user, and the "right" disentangling member 85' pulls or grabs fibrous soils when the head is moved towards the left relative to the user, according to same collection process previously discussed. Among other benefits, a left and right unidirectional disentangling member prevents that fibrous bundle may "escape" from the head portion when a user moves the head portion sideways.

As previously discussed, it can be beneficial to have at least a portion of the bottom surface of the collection member raised above to the CRS during the cleaning operation such that this raised surface does not interact or is not in direct contact with the CRS during the cleaning operation.

Without intending to be bound by any theory, it is believed that when the bottom surface of the collection member includes at least one concave and/or one convex portion, the concave and or convex portions progressively capture and get filled with fibrous bundles.

As also previously discussed, raising the collection member can be done by providing support members, which are away from the CRS, and/or including a height adjustment member for lowering and or raising the collection member.

In one embodiment, the collection member can be preformed to include at least one concave and/or convex portion. The collection member can also be made from a corrugated material including a plurality of concave and convex portions.

In one embodiment, the collection member can be substantially flat and include at least one "weakness" line for allowing a user to fold at least partially the collection member easily in order to create raised and recessed regions.

In one embodiment shown in FIG. 19A, the obstruction member includes a bump or raised portion 1260 in order to limit the contact surface available between the bottom surface of the collection member when it is coated with a tacky polymeric additive and the obstruction member. This bump or raised portion of the obstruction member facilitates the insertion of the collection member within the head of the cleaning implement.

In one embodiment, the surface of the collection member that includes an additive, preferably a tacky polymeric additive, can be covered by a release paper or liner that a user can easily remove after insertion of the collection member. In one embodiment, a user can be instructed to not remove all of the release paper after insertion, but remove the paper only when needed in order to protect at least some of the additive, and as a result to extend the "usable life" or mileage of the collection member. In order to ease the removal of only a portion of the release paper, the release paper can include pre-cut slits or perforation lines which allow the user to remove only predefined portion of the release paper and uncover only portions of the additive.

In one embodiment, release paper or liner can be made of a woven or nonwoven material. The basis weight for the release paper or liner is less than about 150 g/m$^2$, preferably less than about 100 g/m$^2$, and more preferably less than about 75 g/m$^2$.

When a cleaning implement includes an obstructing element that obstructs at least partially the side opening 160, as well as the access to the grooves 170 and/or when a cleaning implement includes a height adjustment member it can be beneficial for the collection member to be at least partially bendable. By "at least partially bendable", it is meant that the collection member bends when a user inserts and pushes the collection member through the opening and within the grooves 170.

Figure 21A:
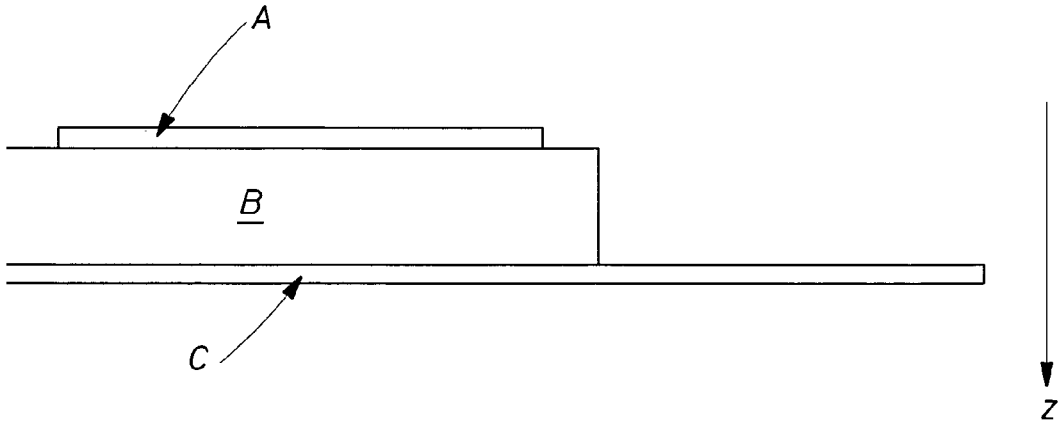
FIG. 21A is a side view of a test for measuring an "Average Drape Value"
Figure 21B:
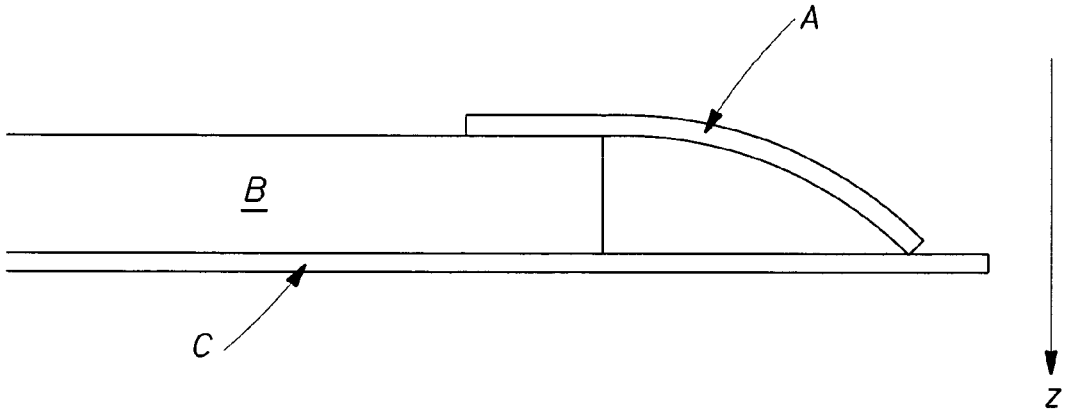
FIG. 21B is another side view of a test for measuring an "Average Drape Value"

The bending or deformation properties of a collection member can be measured according to the following test method schematically represented in FIGS. 21A and 21B.

Five rectangular strips measuring about 150 mm wide and about 300 mm long are cut from a first test sample material having a thickness of less than about 2.5 mm.

A first strip A of the sample material is laid substantially flat on the top surface of a level surface B which is made from 0.5 inch (about 12.7 mm) thick machined aluminum. The surface of the strip A in contact with the level surface is substantially free of any tacky additive which could prevent the strip A from gliding or sliding against the level surface.

A flat, rigid and elongated strip of aluminum C can be attached underneath the level surface such that this aluminum strip is substantially parallel to the level surface and located at about 0.5 inches (about 12.7 mm) from the level surface.

The first strip A is held such that its long sides are substantially perpendicular to a straight edge of the level surface B.

The strip A is moved toward the straight edge of the surface such that the portion of the strip in contact with the level surface B is maintained substantially flat on the level surface and the other portion of the strip is left "hanging" off the level surface.

One skilled in the art will understand that depending on the stiffness or bending properties of sample material, the portion of the strip hanging off the level surface can bend due to its own weight.

The strip is moved until the leading edge of the strip hanging off the surface touches the aluminum strip C. When the leading edge of the strip A touches the aluminum strip C, the downward deflection Dd of the strip A is about 0.5 inches (about 12.7 mm), as shown in FIG. 21B.

The strip A is then marked at the straight edge of surface B.

The strip A is then removed from the level surface B and the distance from the leading edge of the strip that was hanging off the level surface and in contact with the aluminum strip C to the mark just made is measured.

The same measurement is done for the other 4 strip of same test sample material.

The average of these measurements provides an "Average Drape Value."

In the event most of the strip A (i.e. more than about 290 mm) is hanging off the surface level and the leading edge is still not touching the aluminum strip C, a longer sample can be prepared which is tested until the leading edge touches the aluminum strip.

In one embodiment, the collection member is made of a substrate having a width of at less than about 150 mm, a thickness or caliper of less than about 2.5 mm.

In one embodiment, the substrate has an "Average Drape Value" of at least about 40 mm, preferably of at least about 50 mm, more preferably of at least about 60 mm, even more preferably of at least about 70 mm, and most preferably at least about 80 mm.

In one embodiment, the substrate has an "Average Drape Value" of less than about 300 mm, preferably of less than about 280 mm, more preferably of less than about 260 mm, even more preferably of less than about 240 mm, and most preferably of less than 220 mm.

In one embodiment, at least one of the top and/or bottom surface of the collection member includes a tacky additive. The tacky additive can be applied at a level of at least about 10 $g/m^2$, preferably at least about 20 $g/m^2$, more preferably at least about 40 $g/m^2$, even more preferably at least about 80 $g/m^2$.

The inventors have found that when the collection member is made of a substrate having an "Average Drape Value" that is too low (i.e. less than about 40 mm), it can be difficult to insert the collection member within the head portion of the implement because the collection member will tend to collapse on itself, in particular if at least one of the top and/or bottom surface of the substrate include a tacky additive.

Conversely, the inventors have found that when the collection member is made of a substrate having an "Average Drape Value" that is too high (i.e. more than about 300 mm), it can be also difficult to insert the collection member within the head portion of the implement because the collection member may not be able to bend to pass an obstructing member and/or conform to the shape of an height adjustment member.

It will be understood that collection members falling outside of these ranges can be modified in order to provide the desired "Average Drape Value". For example, partial and/or integral cuts, slits or holes can be made to the substrate of collection member to increase its ability to bend under constrain. Conversely, a material can also be reinforced to reduce its ability to bend. For example, the material chosen for the collection member can be folded, bent, corrugated, textured, laminated, and/or include a reinforcing additive such as a binder.

In a one embodiment previously shown in FIGS. 17A and 17B, the cleaning implement comprises a male or female element 360 located on one side of the housing for engaging or being engaged by a corresponding female or male element located on either the left or right portion of the collection member. In a preferred embodiment, the male or female element 360 is positioned adjacent to the side opening 160.

Figure 22A:
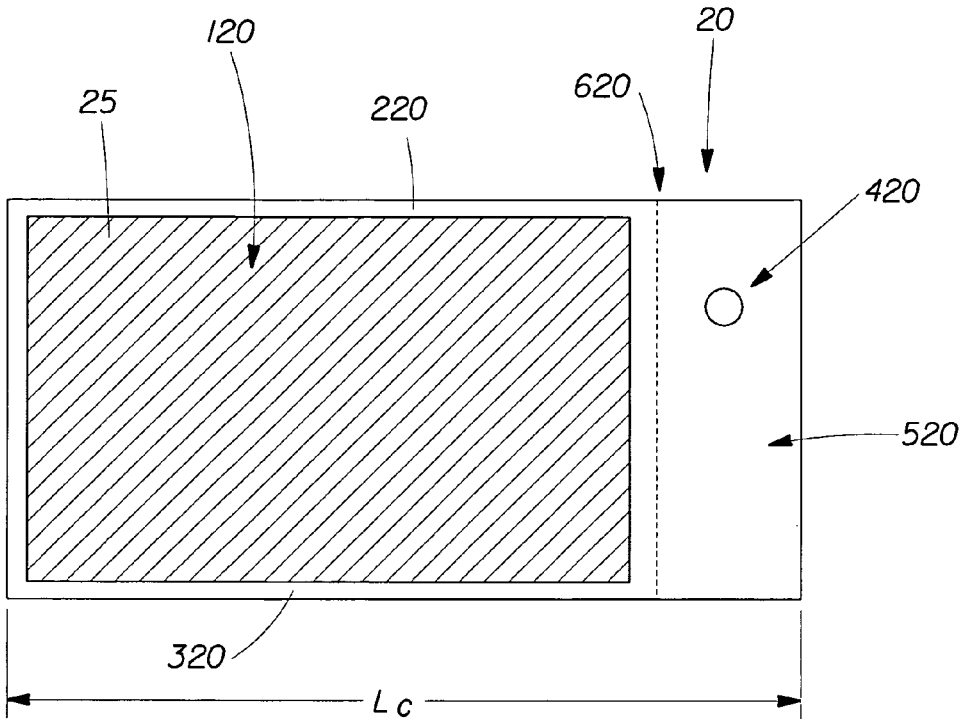
FIG. 22A is a top view of a collection member having a female element.
Figure 22B:
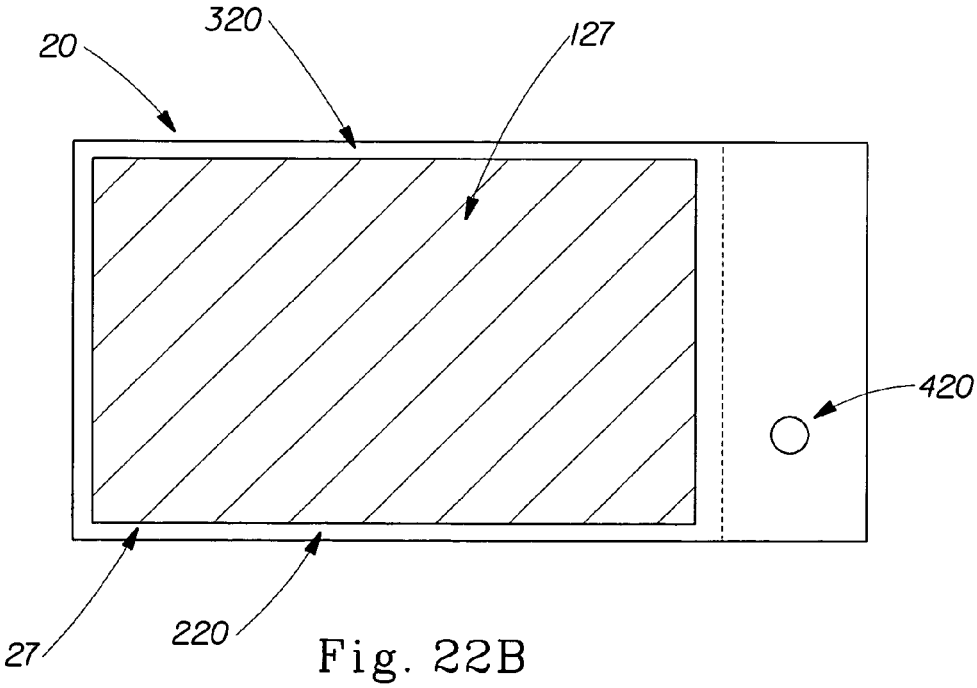
FIG. 22B is a bottom view of a collection member having a female element.

A collection member 20 having a female element 420 is shown in FIGS. 22A-22B. In a preferred embodiment, the male or female element 360 of the cleaning implement is adjacent to the side opening 160. When the collection member is inserted within the side opening 160, a user can then engage the male and female elements in order to prevent the collection member from being accidentally removed from the cleaning implement during the cleaning operation. Non-limiting examples of male and female elements include hook and loop fasteners, tong and groove, hole and projection or any other male and female element know in the art.

In one embodiment, the male or female element 420 of the collection member 20 is positioned on the collection member 20 such that this male or female element can only engage or be engaged by the female or male element of the cleaning implement when the collection surface is oriented in a desired direction/orientation, preferably when the collection surface is facing substantially upwards. One skilled in the art will understand that the previous male/female configuration allows a user to insert the collection member in an appropriate manner, especially if the collection surface includes means for retaining particulates such as pockets and/or an additive and that it is desired that the particulates fall on top of this means for retaining particulates on the collection surface.

In one embodiment shown in FIG. 22B, at least one of the top and/or bottom surfaces of the collection member can include an indicia conveying to the user the proper way to connect the collection member to the cleaning implement. Non-limiting examples of suitable indicia include word(s), icon(s), picture(s), drawing(s) conveying to the user which side or surface of the collection member has to face towards the CRS when the collection member is connected to the implement.

Figure 23:
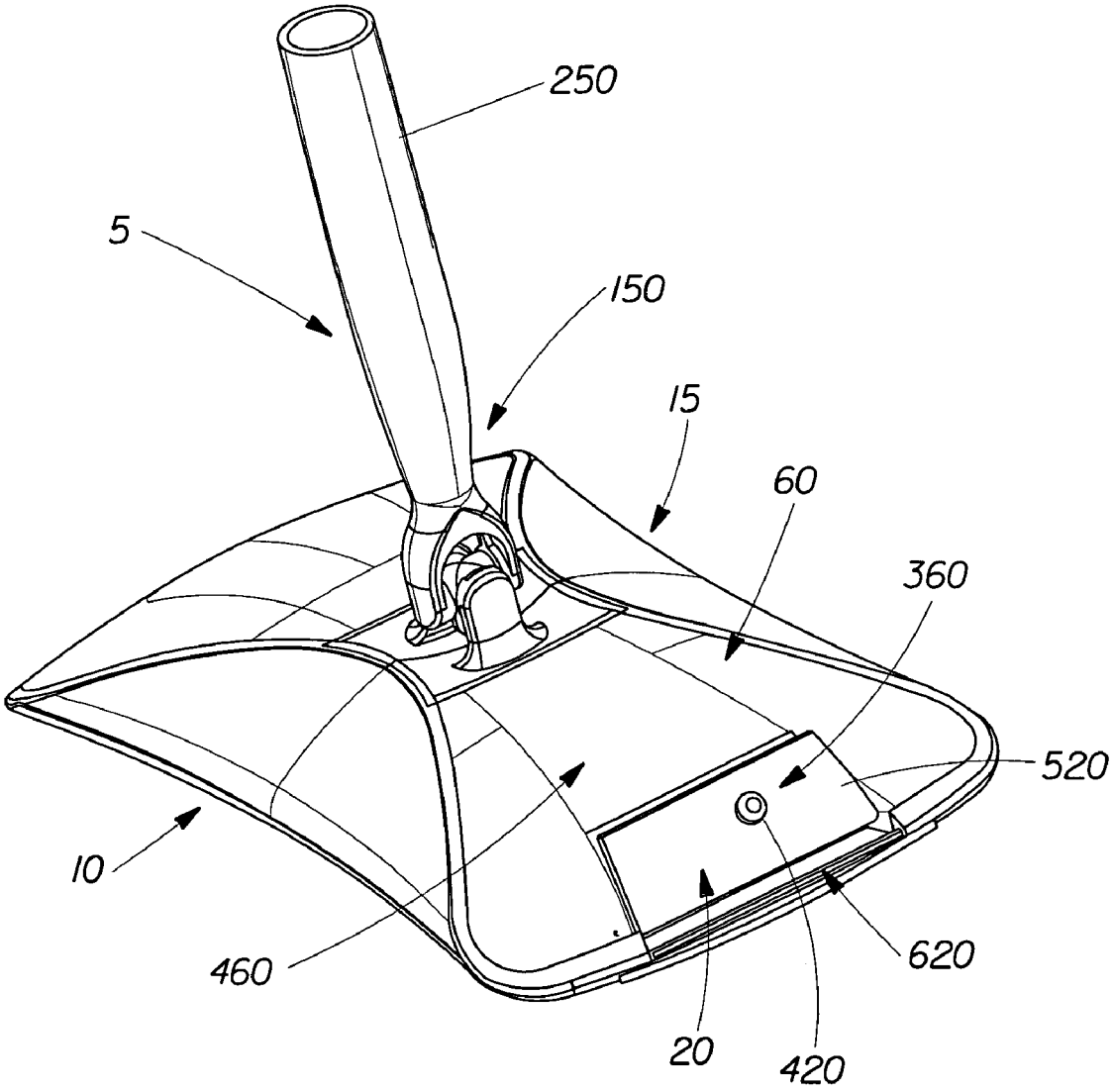
FIG. 23 is a perspective view of a cleaning implement and collection member where the male element of the implement engages the female element of the collection member.

In a one embodiment, the collection member is substantially rectangular and its length Lc is greater than the length of the grooves 170 such that when the user inserts the collection member within the opening, a portion 520 of the collection member is left outside of the cleaning implement. A user can then fold or bend the portion of the collection member left outside the housing such that the male or female element of the collection member engages or is engaged by the corresponding female or male element of the cleaning implement has shown in FIG. 23.

In a preferred embodiment, the collection member comprises a folding line 620 which helps the user fold the portion 520 of the collection member 20 such that the male or female element 420 of the collection member can engage or be engaged by the corresponding females or male element 360 of the cleaning implement 5. The folding line can include perforations, slits or holes to facilitate the folding of the portion 520.

In one embodiment, at least a portion, preferably a top portion 460 of the redirecting member 60 of the cleaning implement 5 is not totally opaque and can be transparent or translucent. By "not totally opaque" it is meant that in regular daylight and within a distance of at least about 1.5 m, a user can see through this portion 460 and discern objects through this portion. Among other benefits, a non-opaque portion allows a user to determine if the collection surface of the collection member is saturated with particulate soils and if a collection member has been properly inserted within the side opening and/or connected to the implement.

Any of the cleaning implements previously described can also be used in combination with known carpet cleaning products that can be dispensed onto the carpet in the form of a powder, particulates, liquid, foam, gel, and any combination thereof for spot cleaning or overall carpet freshening.

While particular embodiments of the subject invention have been described, it will be obvious to those skilled in the art that various changes and modifications of the subject invention can be made without departing from the spirit and scope of the invention. In addition, while the present invention has been described in connection with certain specific embodiments thereof, it is to be understood that the scope of the invention is defined by the appended claims which should be construed as broadly as the prior art will permit.

What is claimed is:

1. A cleaning implement for removing particulates from a compressible resilient surface, the cleaning implement comprising:

a first ramp and a second ramp, each ramp having an outer surface for pressing said particulates against said compressible resilient surface, said ramp having a lower edge; wherein the outer surface of said first ramp and the outer surface of said second ramp are not facing the same direction; and a collection member for collecting said particulates, wherein said collection member is statically connected to said ramp when said ramp is moved across a compressible resilient surface, said collection member having a collection surface located between the first and second ramps of said cleaning implement, wherein said particulates are projected away from said compressible resilient surface onto said collection surface when said outer surface of said ramp is compressibly moved across said compressible resilient surface and against said particulates.

2. The cleaning implement of claim 1 wherein the distance between said collection member and said lower edge is between about 1 mm and about 200 mm.

3. The cleaning implement of claim 2 wherein the distance between said collection member and said lower edge is between about 2 mm and about 100 mm.

4. The cleaning implement of claim 3 wherein the distance between said collection member and said lower edge is between about 5 mm and about 50 mm.

5. The cleaning implement of claim 1 wherein said collection member has a top and a bottom surface and wherein said particulates are collected by said top surface of said collection member.

6. A method of removing particulates from a compressible resilient surface comprising:

providing a cleaning implement according to claim 1;

compressibly moving the outer surface of said ramp across said compressible resilient surface and against said particulates such that said particulates are projected onto said collection surface.

7. A cleaning implement for removing particulates from a compressible resilient surface, the cleaning implement comprising:

a first ramp and a second ramp, each ramp having an outer surface for pressing said particulates against said compressible resilient surface, said ramp having a lower edge; wherein the outer surface of said first ramp and the outer surface of said second ramp are not facing the same direction; and a collection member for collecting said particulates, wherein said collection member is removably connected to said cleaning implement said collection member having a collection surface located between the first and second ramps of said cleaning implement, wherein said particulates are projected away from said compressible resilient surface onto said collection surface when said outer surface of said ramp is compressibly moved across said compressible resilient surface and against said particulates.

8. The cleaning implement of claim 7 wherein said collection member substantially prevents said particulates from falling back onto said compressible resilient surface.

9. The cleaning implement of claim 7 wherein said collection member is disposable.

10. A cleaning implement for removing particulates from a compressible resilient surface, the cleaning implement comprising:

a first ramp and a second ramp, each ramp having an outer surface for pressing said particulates against said compressible resilient surface, said ramp having a lower edge; wherein the outer surface of said first ramp and the outer surface of said second ramp are not facing the same direction; and a collection member for collecting said particulates, wherein said collection member is operably connected to said ramp, said collection member having a collection surface located between the first and second ramps of said cleaning implement, wherein said particulates are projected away from said compressible resilient surface onto said collection surface when said outer surface of said ramp is compressibly moved across said compressible resilient surface and against said particulates said outer surface of said second ramp having a vertical height and horizontal width, wherein the cross-sectional shape of said outer surface of said second ramp in a vertical plane is such that it has at least one tangential angle of less than about 70 degrees when measured at a vertical height of between about 2 and 30 mm, such that said second ramp passes on top of said large particulates and said large particulates are projected away from said compressible resilient surface when said outer surface of said second ramp is compressibly moved across said compressible resilient surface and said large particulates.

11. The cleaning implement of claim 10 wherein the horizontal width of said ramp is between about 5 mm and 100 mm.

12. A cleaning implement for removing particulates from a compressible resilient surface, the cleaning implement comprising:

a first ramp having an outer surface for pressing said particulates against said compressible resilient surface when said cleaning implement is moved across said compressible resilient surface in a forward motion of said cleaning implement, said first ramp having a lower edge;

a second ramp having an having an outer surface for pressing said particulates against said compressible resilient surface when said cleaning implement is moved across said compressible resilient surface in a backward motion of said cleaning implement, said second ramp having a lower edge;

an upper housing operably connected to said first and second ramp such that said housing and said first and second ramps form a substantially hollow space; and a collection member for collecting particulates projected from said compressible resilient surface, wherein said collection member is operably connected to said cleaning implement and wherein said collection member comprises a collection surface which does not contact said compressible resilient surface while said cleaning implement is moved across said compressible resilient surface.

13. The cleaning implement of claim 12 wherein said collection member is removably connected to said cleaning implement.

14. The cleaning implement of claim 13 wherein said collection member is a disposable substrate.

15. The cleaning implement of claim 14 wherein the collecting surface of said disposable surface comprises an additive.

16. The cleaning implement of claim 15 wherein said additive is at least one of a wax; a pressure sensitive adhesive; a tacky polymer; and mixtures thereof.

17. The cleaning implement of claim 13 wherein said particulates are projected onto said collection surface when said collection member is at least partially connected to said cleaning implement and wherein said particulates fall back on said compressible resilient surface when said collection member is not connected to said cleaning implement.

* * * * *